US011361727B1

(12) United States Patent
Zhou

(10) Patent No.: US 11,361,727 B1
(45) Date of Patent: Jun. 14, 2022

(54) PIXEL CIRCUIT FOR IMPROVING DISPLAY OF STATIC IMAGES IN MEMORY-IN-PIXEL (MIP) TECHNOLOGY AND DRIVE METHOD THEREFOF, DISPLAY PANEL, AND DISPLAY DEVICE

(71) Applicant: Xiamen Tianma Micro-Electronics Co., Ltd., Xiamen (CN)

(72) Inventor: Liang Zhou, Shanghai (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 17/166,169

(22) Filed: Feb. 3, 2021

(30) Foreign Application Priority Data

Dec. 1, 2020 (CN) ..... 202011385772

(51) Int. Cl.
*G09G 3/36* (2006.01)

(52) U.S. Cl.
CPC ..... *G09G 3/3688* (2013.01); *G09G 3/3677* (2013.01); *G09G 2300/0823* (2013.01); *G09G 2300/0852* (2013.01)

(58) Field of Classification Search
CPC ..... G09G 3/36; G09G 3/3611; G09G 3/3622; G09G 3/3625; G09G 3/364; G09G 3/3677; G09G 3/3681; G09G 3/3685; G09G 3/3688; G09G 3/3692; G09G 2300/0852; G09G 2300/0857
USPC ..... 345/87–104
See application file for complete search history.

(56) References Cited

U.S. PATENT DOCUMENTS 6,169,532 B1 * 1/2001 Sumi ..... G09G 3/2011 345/212
2002/0047822 A1 * 4/2002 Senda ..... G09G 3/3655 345/90
2008/0174612 A1 * 7/2008 Someya ..... G09G 3/2044 345/89
2011/0175883 A1 * 7/2011 Toyotaka ..... G02F 1/136286 345/87
2012/0001951 A1 * 1/2012 Katagawa ..... G09G 3/3648 345/690

(Continued)

FOREIGN PATENT DOCUMENTS

CN 105632440 A 6/2016
CN 106469542 A 3/2017
CN 109545137 A 3/2019

*Primary Examiner* — Alexander Eisen
*Assistant Examiner* — Nelson Lam
(74) *Attorney, Agent, or Firm* — Anova Law Group, PLLC

(57) ABSTRACT

The pixel circuit and its drive method, the display panel, and the display device are provided in the present disclosure. The pixel circuit includes a data write unit, a voltage compensation unit, a first switch unit, a second switch unit, a third switch unit, a liquid crystal capacitor, and a storage capacitor. In a dynamic display stage, the first switch unit and the second switch unit are turned on for conduction; and the data write unit transmits a data voltage signal to the liquid crystal capacitor and the storage capacitor. In a static display stage, the third switch unit is turned on for conduction; the voltage compensation unit is controlled to be in conduction through first and second reference voltage signals and a potential signal of the storage capacitor; and a first voltage signal terminal transmits a first voltage signal to the liquid crystal capacitor.

18 Claims, 15 Drawing Sheets

(56) References Cited

U.S. PATENT DOCUMENTS

| | | | | |
|---|---|---|---|---|
| 2013/0286001 | A1* | 10/2013 | Nakano | G09G 3/3648<br>345/212 |
| 2014/0320479 | A1* | 10/2014 | Kaneko | G02F 1/13306<br>345/212 |
| 2018/0114497 | A1* | 4/2018 | Tan | G09G 3/3651 |

* cited by examiner

PIXEL CIRCUIT FOR IMPROVING DISPLAY OF STATIC IMAGES IN MEMORY-IN-PIXEL (MIP) TECHNOLOGY AND DRIVE METHOD THEREFOF, DISPLAY PANEL, AND DISPLAY DEVICE

CROSS-REFERENCE TO RELATED APPLICATION

This application claims the priority of Chinese Patent Application No. 202011385772.3, filed on Dec. 1, 2020, the content of which is incorporated herein by reference in its entirety.

TECHNICAL FIELD

The present disclosure generally relates to the field of display technology and, more particularly, relates to a pixel circuit and its drive method, a display panel, and a display device.

BACKGROUND

With the development of smart wearables, mobile applications and the like, requirements have been put forward for the development of ultra-low power display technology. The current mainstream low power display on the market is electronic paper. Although the power consumption of the electronic paper is low, it may not be sufficient to display dynamic pictures, and the overall display effect may still not as desirable as the liquid crystal display (LCD).

Memory-in-pixel (MIP) display technology, as a new low power LCD display technology, has broad development prospects due to its characteristics such as no need to modify the existing LCD process, no new material development needed, simple structure, low cost, and the like.

The circuit structure used by the existing MIP display technology may be relatively complicated and only implement black and white display for static images, which greatly limits the application range of the MIP display technology.

SUMMARY

One aspect of the present disclosure provides a pixel circuit. The pixel circuit includes a data write unit, a voltage compensation unit, a first switch unit, a second switch unit, a third switch unit, a liquid crystal capacitor, and a storage capacitor. The data write unit is electrically connected to each of a first terminal of the first switch unit and a first terminal of the second switch unit; a second terminal of the first switch unit is electrically connected to a first terminal of the liquid crystal capacitor, and a control terminal of the first switch unit is electrically connected to a first control-signal terminal; a second terminal of the second switch unit is electrically connected to a first terminal of the storage capacitor, and a control terminal of the second switch unit is electrically connected to the first control-signal terminal; a first terminal of the third switch unit is electrically connected to the voltage compensation unit, a second terminal of the third switch unit is electrically connected to the first terminal of the liquid crystal capacitor, and a control terminal of the third switch unit is electrically connected to the first control-signal terminal; the voltage compensation unit is electrically connected to the first terminal of the storage capacitor, and the voltage compensation unit is electrically connected to each of a first reference voltage signal terminal, a second reference voltage signal terminal, and a first voltage signal terminal; a second terminal of the liquid crystal capacitor is electrically connected to a first common voltage signal terminal; a second terminal of the storage capacitor is electrically connected to a second common voltage signal terminal. In a dynamic display stage, the first switch unit and the second switch unit are turned on for conduction, and the third switch unit is turned off for disconnection; and the data write unit transmits a data voltage signal on a data line to the liquid crystal capacitor and the storage capacitor. In a static display stage, the first switch unit and the second switch unit are turned off for disconnection, and the third switch unit is turned on for conduction; the voltage compensation unit is controlled to be in conduction through a first reference voltage signal of the first reference voltage signal terminal, a second reference voltage signal of the second reference voltage signal terminal, and a potential signal of the first terminal of the storage capacitor; and the first voltage signal terminal transmits a first voltage signal to the liquid crystal capacitor through the voltage compensation unit.

Another aspect of the present disclosure provides a method for driving a pixel circuit. The pixel circuit includes a data write unit, a voltage compensation unit, a first switch unit, a second switch unit, a third switch unit, a liquid crystal capacitor, and a storage capacitor. The data write unit is electrically connected to each of a first terminal of the first switch unit and a first terminal of the second switch unit; a second terminal of the first switch unit is electrically connected to a first terminal of the liquid crystal capacitor, and a control terminal of the first switch unit is electrically connected to a first control-signal terminal; a second terminal of the second switch unit is electrically connected to a first terminal of the storage capacitor, and a control terminal of the second switch unit is electrically connected to the first control-signal terminal; a first terminal of the third switch unit is electrically connected to the voltage compensation unit, a second terminal of the third switch unit is electrically connected to the first terminal of the liquid crystal capacitor, and a control terminal of the third switch unit is electrically connected to the first control-signal terminal; the voltage compensation unit is electrically connected to the first terminal of the storage capacitor, and the voltage compensation unit is electrically connected to each of a first reference voltage signal terminal, a second reference voltage signal terminal, and a first voltage signal terminal; a second terminal of the liquid crystal capacitor is electrically connected to a first common voltage signal terminal; a second terminal of the storage capacitor is electrically connected to a second common voltage signal terminal. In a dynamic display stage, the first switch unit and the second switch unit are turned on for conduction, and the third switch unit is turned off for disconnection; and the data write unit transmits a data voltage signal on a data line to the liquid crystal capacitor and the storage capacitor. In a static display stage, the first switch unit and the second switch unit are turned off for disconnection, and the third switch unit is turned on for conduction; the voltage compensation unit is controlled to be in conduction through a first reference voltage signal of the first reference voltage signal terminal, a second reference voltage signal of the second reference voltage signal terminal, and a potential signal of the first terminal of the storage capacitor; and the first voltage signal terminal transmits a first voltage signal to the liquid crystal capacitor through the voltage compensation unit.

Another aspect of the present disclosure provides a display panel. The display panel includes a plurality of scan lines, a plurality of data lines, and a plurality of pixels. The plurality of scan lines extends along a first direction and is arranged along a second direction; the plurality of data lines extends along the second direction and is arranged along the first direction; the plurality of pixels is arranged in an array along the first direction and the second direction, where the first direction intersects the second direction; each pixel includes one pixel circuit including a data write unit, a voltage compensation unit, a first switch unit, a second switch unit, a third switch unit, a liquid crystal capacitor, and a storage capacitor. A control terminal of the data write unit is electrically connected to a scan line, a first terminal of the data write unit is electrically connected to a data line, and a second terminal of the data write unit is electrically connected to each of a first terminal of the first switch unit and a first terminal of the second switch unit; a second terminal of the first switch unit is electrically connected to a first terminal of the liquid crystal capacitor, and a control terminal of the first switch unit is electrically connected to a first control-signal terminal; a second terminal of the second switch unit is electrically connected to a first terminal of the storage capacitor, and a control terminal of the second switch unit is electrically connected to the first control-signal terminal; a first terminal of the third switch unit is electrically connected to the voltage compensation unit, a second terminal of the third switch unit is electrically connected to the first terminal of the liquid crystal capacitor, and a control terminal of the third switch unit is electrically connected to the first control-signal terminal; the voltage compensation unit is electrically connected to the first terminal of the storage capacitor; and the voltage compensation unit is electrically connected to each of a first reference voltage signal terminal, a second reference voltage signal terminal, and a first voltage signal terminal; a second terminal of the liquid crystal capacitor is electrically connected to a first common voltage signal terminal; and a second terminal of the storage capacitor is electrically connected to a second common voltage signal terminal. In a dynamic display stage, the first switch unit and the second switch unit are turned on for conduction, and the third switch unit is turned off for disconnection; and the data write unit transmits a data voltage signal on a data line, which is electrically connected to the data write unit, to the liquid crystal capacitor and the storage capacitor. In a static display stage, the first switch unit and the second switch unit are turned off for disconnection, and the third switch unit is turned on for conduction; the voltage compensation unit is controlled to be in conduction through a first reference voltage signal of the first reference voltage signal terminal, a second reference voltage signal of the second reference voltage signal terminal, and a potential signal of the first terminal of the storage capacitor; and the first voltage signal terminal transmits a first voltage signal to the liquid crystal capacitor through the voltage compensation unit.

Another aspect of the present disclosure provides a display device including the display panel according to the embodiments of the present disclosure.

Other aspects of the present disclosure can be understood by those skilled in the art in light of the description, the claims, and the drawings of the present disclosure.

BRIEF DESCRIPTION OF THE DRAWINGS

Drawings incorporated in the specification and forming a part of the specification demonstrate the embodiments of the present disclosure and, together with the specification, describe the principles of the present disclosure.

DETAILED DESCRIPTION

Figure 1:
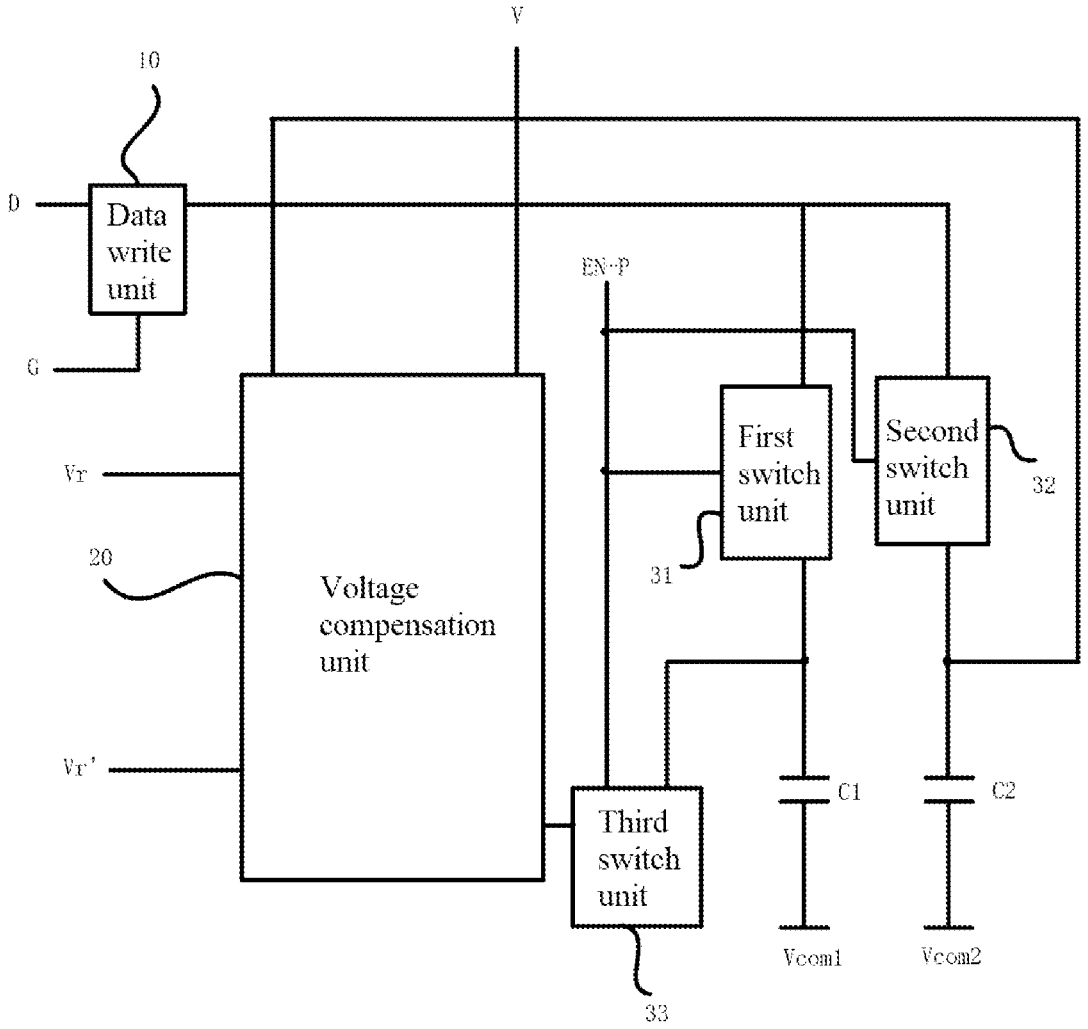
FIG. 1 illustrates a circuit schematic of a pixel circuit according to various embodiments of the present disclosure.

Various embodiments of the present disclosure are described in detail with reference to the drawings. It should be noted that the relative arrangement of components and steps, numerical expressions, and numerical values set forth in the embodiments may not limit the scope of the present disclosure unless specifically stated otherwise.

The following description of at least one exemplary embodiment is merely illustrative, which may not limit the present disclosure and its application or use.

Techniques, methods and equipment known to those skilled in the art may not be discussed in detail, but where appropriate, the techniques, methods and equipment should be considered as a part of the specification.

In all exemplary embodiments shown and discussed herein, any specific values should be interpreted as merely exemplary and not limiting. Therefore, other examples of the exemplary embodiments may have different values.

It should be noted that similar reference numerals and letters indicate similar items in the following drawings. Therefore, once an item is defined in one drawing, there is no need to discuss it further in subsequent drawings.

FIG. 1 illustrates a circuit schematic of a pixel circuit according to various embodiments of the present disclosure. Referring to FIG. 1, the pixel circuit may include two working stages: a dynamic display stage and a static display stage. The pixel circuit may include a data write unit 10, a voltage compensation unit 20, a first switch unit 31, a second switch unit 32, a third switch unit 33, a liquid crystal capacitor C1, and a storage capacitor C2.

The data write unit 10 may be electrically connected to each of the first terminal of the first switch unit 31 and the first terminal of the second switch unit 32;

the second terminal of the first switch unit 31 may be electrically connected to the first terminal of the liquid crystal capacitor C1, and the control terminal of the first switch unit 31 may be electrically connected to a first control-signal terminal EN-P;

the second terminal of the second switch unit 32 may be electrically connected to the first terminal of the storage capacitor C2, and the control terminal of the second switch unit 32 may be electrically connected to the first control-signal terminal EN-P;

the first terminal of the third switch unit 33 may be electrically connected to the voltage compensation unit 20, the second terminal of the third switch unit 33 may be electrically connected to the first terminal of the liquid crystal capacitor C1, and the control terminal of the third switch unit 33 may be electrically connected to the first control-signal terminal EN-P;

the voltage compensation unit 20 may be electrically connected to the first terminal of the storage capacitor C2, and the voltage compensation unit 20 may be electrically connected to each of a first reference voltage signal terminal Vr, a second reference voltage signal terminal Vr', and a first voltage signal terminal V;

the second terminal of the liquid crystal capacitor C1 may be electrically connected to a first common voltage signal terminal Vcom1; and the second terminal of the storage capacitor C2 may be electrically connected to a second common voltage signal terminal Vcom2.

In the dynamic display stage, the first switch unit 31 and the second switch unit 32 may be turned on for conduction, and the third switch unit 33 may be turned off for disconnection; and the data write unit 10 may transmit a data voltage signal on a data line D to the liquid crystal capacitor C1 and the storage capacitor C2.

In the static display stage, the first switch unit 31 and the second switch unit 32 may be turned off for disconnection, and the third switch unit 33 may be turned on for conduction; the voltage compensation unit 20 may be controlled to be in conduction through a first reference voltage signal of the first reference voltage signal terminal Vr, a second reference voltage signal of the second reference voltage signal terminal Vr', and a potential signal of the first terminal of the storage capacitor C2; and the first voltage signal terminal Vr may transmit a first voltage signal to the liquid crystal capacitor C1 through the voltage compensation unit 20.

For example, referring to FIG. 1, the pixel circuit provided in one embodiment may include two working stages: the dynamic display stage and the static display stage. In the dynamic display stage, the pixel circuit may be configured to display dynamic pictures, and in the static display stage, the pixel circuit may be configured to display static pictures. The pixel circuit may include the data write unit 10, the voltage compensation unit 20, the first switch unit 31, the second switch unit 32, the third switch unit 33, the liquid crystal capacitor C1, and the storage capacitor C2.

The data write unit 10 may be electrically connected to each of the first terminal of the first switch unit 31 and the first terminal of the second switch unit 42; the second terminal of the first switch unit 31 may be electrically connected to the liquid crystal capacitor C1, and the control terminal of the first switch unit 31 may be electrically connected to the first control-signal terminal EN-P; the second terminal of the second switch unit 32 may be electrically connected to the first terminal of the storage capacitor C2, and the control terminal of the second switch unit 32 may be electrically connected to the first control-signal terminal EN-P; the first terminal of the third switch unit 33 may be electrically connected to the voltage compensation unit 20, the second terminal of the third switch unit 33 may be electrically connected to the first terminal of the liquid crystal capacitor C1, and the control terminal of the third switch unit 33 may be electrically connected to the first control-signal terminal EN-P. In the dynamic display stage, the first switch unit 31 and the second switch unit 32 may be controlled to be in conduction and the third switch unit 33 may be controlled to be in disconnection through the signal of the first control-signal terminal EN-P; and the data write unit 10 may transmit the data voltage signal on the data line D to the liquid crystal capacitor C1 and the storage capacitor C2. The display panel may generate a corresponding liquid crystal deflection electric field, based on the liquid crystal capacitor C1, according to the data voltage signal on the data line D, and the storage capacitor C2 may store the data voltage signal on the data line D.

The voltage compensation unit 20 may be electrically connected to the first terminal of the storage capacitor C2; the voltage compensation unit 20 may be electrically connected to the first reference voltage signal terminal Vr, the second reference voltage signal terminal Vr' and the first voltage signal terminal V; the second terminal of the liquid crystal capacitor C1 may be electrically connected to the first common voltage signal terminal Vcom1; and the second terminal of the storage capacitor C2 may be electrically connected to the second common voltage signal terminal Vcom2. In the static display stage, the signal of the first control-signal terminal EN-P may be used to control the first switch unit 31 and the second switch unit 32 to be in disconnection and to control the third switch unit 33 to be in conduction; the first reference voltage signal of the first reference voltage signal terminal Vr, the second reference voltage signal of the second reference voltage signal terminal Vr', and the potential signal of the first terminal of the storage capacitor C2 may be used to control the voltage compensation unit 20 to be in conduction; the first voltage signal terminal Vr may transmit the first voltage signal to the liquid crystal capacitor C1 through the voltage compensation unit 20; and the display panel may generate a corresponding liquid crystal deflection electric field, based on the liquid crystal capacitor C1, according to the first voltage signal provided by the first voltage signal terminal Vr. At this point, the first voltage signal provided by the first voltage signal terminal Vr may correspond to the data voltage of each display grayscale, thereby supporting the color picture display in the static display stage.

Moreover, in the existing technology, a storage circuit may be usually disposed to store the data voltage in the normal display stage, and the data voltage may be directly provided to the liquid crystal capacitor in the static display stage. In the static display stage, the storage circuit may have leakage, and the data voltage provided by the storage circuit may inevitably deviate from an original grayscale data voltage with the time accumulation, which may affect the display effect of the display panel in the static display stage. According to the pixel circuit provided in one embodiment, the display panel may generate a corresponding liquid crystal deflection electric field based on the liquid crystal capacitor C1 according to the first voltage signal provided by the first voltage signal terminal Vr, and the data voltage signal may not be provided to the liquid crystal capacitor via the storage circuit. Therefore, the situation that the data voltage signal provided by the storage circuit to the liquid crystal capacitor deviates from the data voltage of the original grayscale due to the time accumulation in the static display stage may not occur, which may be beneficial for improving the display effect of the display panel.

Figure 2:
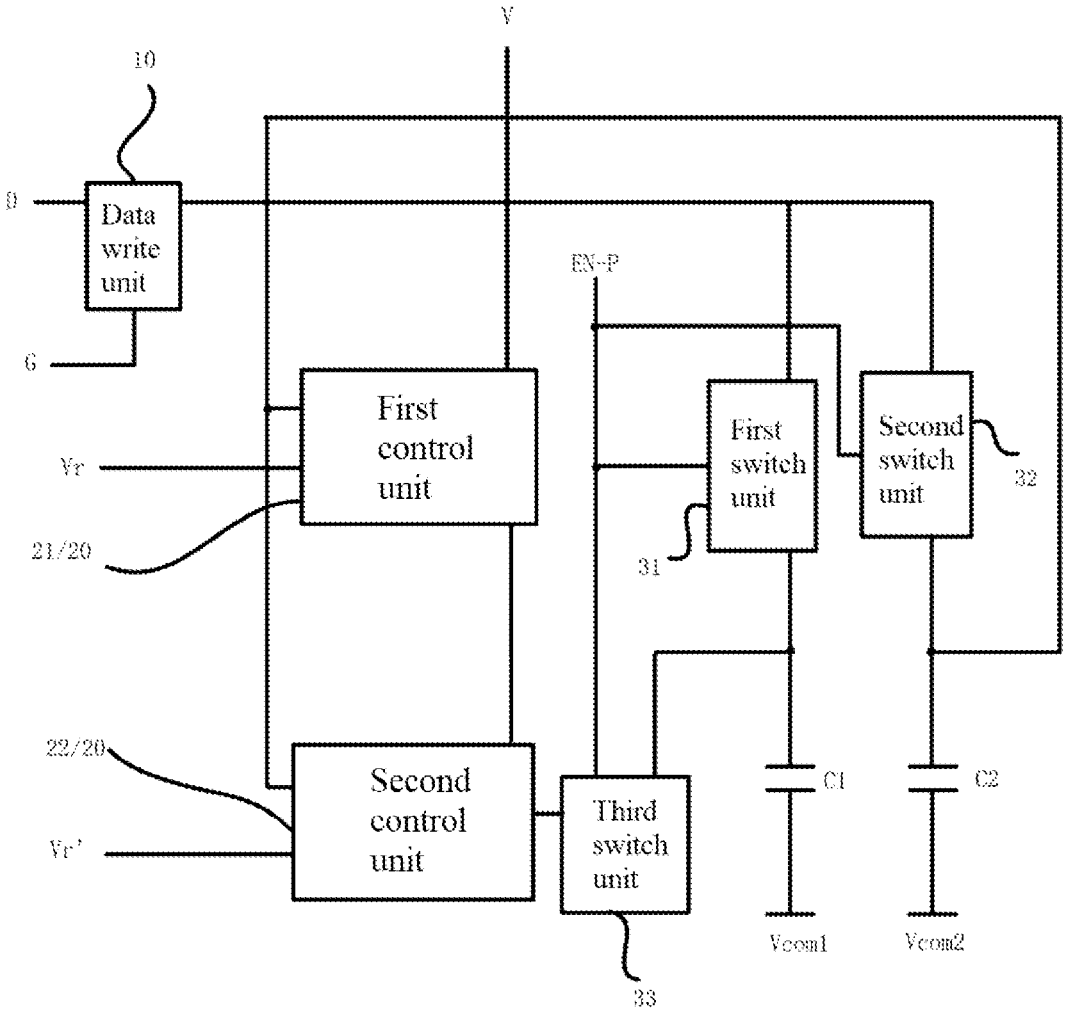
FIG. 2 illustrates a circuit schematic of another pixel circuit according to various embodiments of the present disclosure.

FIG. 2 illustrates a circuit schematic of another pixel circuit according to various embodiments of the present disclosure. Referring to FIG. 2, optionally, the voltage compensation unit 20 may include a first control unit 21 and a second control unit 22 which are electrically connected with each other.

The first control unit 21 may be electrically connected to the first reference voltage signal terminal Vr, the storage capacitor C2, and the first voltage signal terminal V; and the second control unit 22 may be electrically connected to the second reference voltage signal terminal Vr', the storage capacitor C2, and the third switch unit 33.

In the static display stage, the first control unit 21 may be controlled to be in conduction through the first reference voltage signal of the first reference voltage signal terminal Vr and the potential signal of the first terminal of the storage capacitor C2; the second control unit 22 may be controlled to be in conduction through the second reference voltage signal of the second reference voltage signal terminal Vr' and the potential signal of the first terminal of the storage capacitor C2; and the first voltage signal terminal V may transmit the first voltage signal to the liquid crystal capacitor C1 through the first control unit 21 and the second control unit 22.

For example, referring to FIG. 2, the voltage compensation unit 20 in the pixel circuit provided in one embodiment may include the first control unit 21 and the second control unit 22 that are electrically connected to each other; the first control unit 21 may be electrically connected to the first reference voltage signal terminal Vr and the storage capacitor C2; and the second control unit 22 may be electrically connected to the second reference voltage signal terminal Vr' and the storage capacitor C2. In the static display stage, the conduction and disconnection of the first control unit 21 may be controlled through the first reference voltage signal of the first reference voltage signal terminal Vr and the potential signal of the first terminal of the storage capacitor C2; and the conduction and disconnection of the second control unit 22 may be controlled through the second reference voltage signal of the second reference voltage signal terminal Vr' and the potential signal of the first terminal of the storage capacitor C2. Moreover, the first control unit 21 may be electrically connected to the first voltage signal terminal V, and the second control unit 22 may be electrically connected to the third switch unit 33; when the first control unit 21 and the second control unit 22 are both in conduction, the first voltage signal terminal V may transmit the first voltage signal to the third switch unit 33 through the first control unit 21 and the second control unit 22; and when the third switch unit 33 is in conduction, the first voltage signal terminal V transmit the first voltage signal to the liquid crystal capacitor C1.

Figure 3:
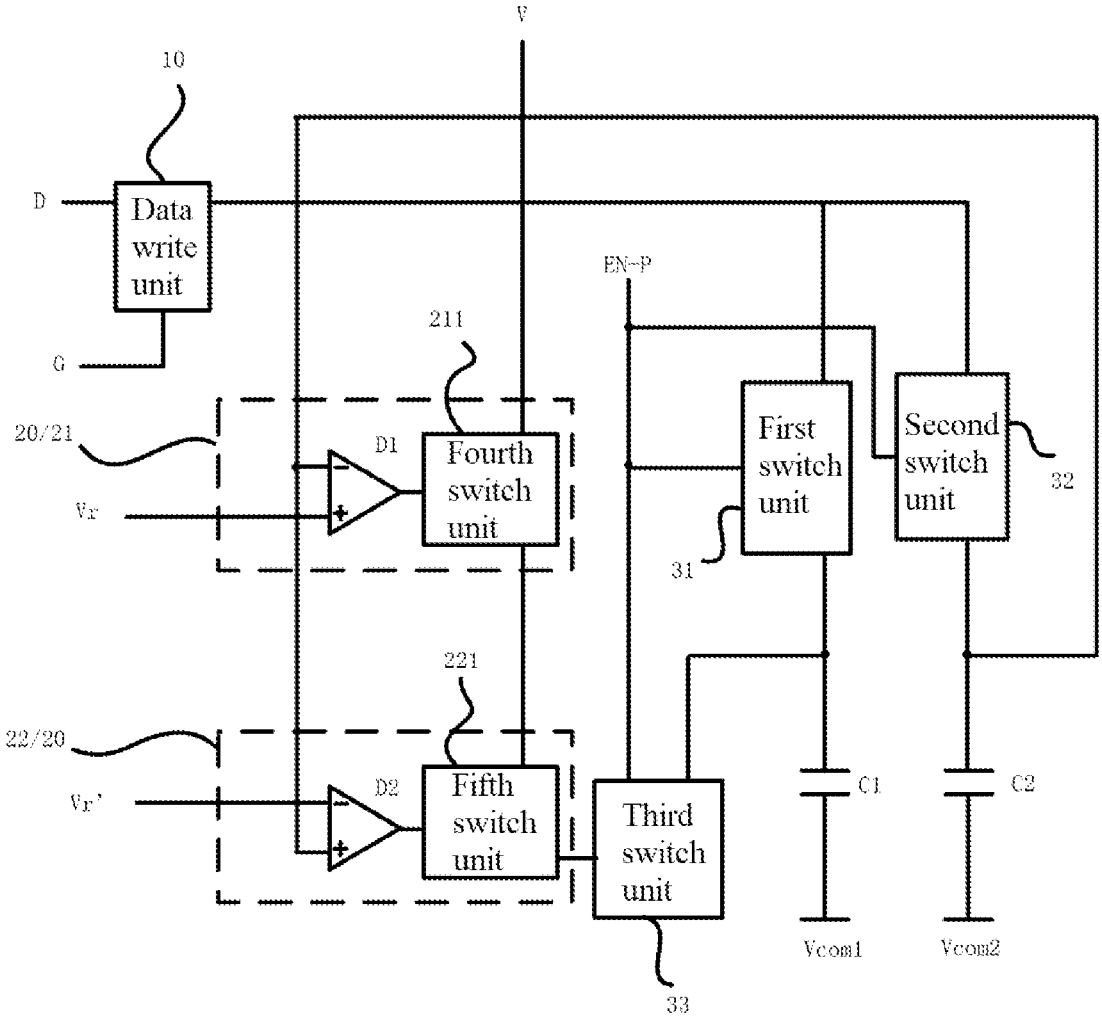
FIG. 3 illustrates a circuit schematic of another pixel circuit according to various embodiments of the present disclosure.

FIG. 3 illustrates a circuit schematic of another pixel circuit according to various embodiments of the present disclosure. Referring to FIG. 3, optionally, the first control unit 21 may include a first comparator D1 and a fourth switch unit 211; the first input terminal of the first comparator D1 may be electrically connected to the storage capacitor C2; the second input terminal of the first comparator D1 may be electrically connected to the first reference voltage signal terminal Vr; the output terminal of the first comparator D1 may be electrically connected to the control terminal of the fourth switch unit 211; and the first terminal of the fourth switch unit 211 may be electrically connected to the first voltage signal terminal V.

The second control unit 22 may include a second comparator D2 and a fifth switch unit 221; the first input terminal of the second comparator D2 may be electrically connected to the second reference voltage signal terminal Vr'; the second input terminal of the second comparator D2 may be electrically connected to the storage capacitor C2; the output terminal of the second comparator D2 may be electrically connected to the control terminal of the fifth switch unit 221; the first terminal of the fifth switch unit 221 may be electrically connected to the second terminal of the fourth switch unit 211; and the second terminal of the fifth switch unit 221 may be electrically connected to the third switch unit 33.

When the voltage of the first input terminal of the first comparator D1 is greater than the voltage of the second input terminal of the first comparator D1, the output terminal of the first comparator D1 may control the fourth switch unit 211 to be in conduction. When the voltage of the first input terminal of the first comparator D1 is less than the voltage of the second input terminal of the first comparator D1, the output terminal of the first comparator D1 may control the fourth switch unit 211 to be in disconnection.

When the voltage of the first input terminal of the second comparator D2 is greater than the voltage of the second input terminal of the second comparator D2, the output terminal of the second comparator D2 may control the fifth switch unit 221 to be in conduction. When the voltage of the first input terminal of the second comparator D2 is less than the voltage of the second input terminal of the second comparator D2, the output terminal of the second comparator D2 may control the fifth switch unit 221 to be in disconnection.

For example, referring to FIG. 3, in the pixel circuit provided in one embodiment, the first control unit 21 may include the first comparator D1 and the fourth switch unit 211; the first input terminal of the first comparator D1 may be electrically connected to the storage capacitor C2; the second input terminal of the first comparator D1 may be electrically connected to the first reference voltage signal terminal Vr; and the output terminal of the first comparator D1 may be electrically connected to the control terminal of the fourth switch unit 211. When the voltage of the first input terminal of the first comparator D1 is greater than the voltage of the second input terminal of the first comparator D1, the output terminal of the first comparator D1 may control the fourth switch unit 211 to be in conduction. When the voltage of the first input terminal of the first comparator D1 is less than the voltage of the second input terminal of the first comparator D1, the output terminal of the first comparator D1 may control the fourth switch unit 211 to be in disconnection. Therefore, in the static display stage, the first control unit 21 may be controlled to be in conduction and disconnection through the first reference voltage signal of the first reference voltage signal terminal Vr and the potential signal of the first terminal of the storage capacitor C2.

The second control unit 22 may include the second comparator D2 and the fifth switch unit 221. The first input terminal of the second comparator D2 may be electrically connected to the second reference voltage signal terminal Vr'; the second input terminal of the second comparator D2 may be electrically connected to the storage capacitor C2; the output terminal of the second comparator D2 may be electrically connected to the control terminal of the fifth switch unit 221; the first terminal of the fifth switch unit 221 may be electrically connected to the second terminal of the fourth switch unit 211; and the second terminal of the fifth switch unit 221 may be electrically connected to the third switch unit 33. When the voltage of the first input terminal of the second comparator D2 is greater than the voltage of the second input terminal of the second comparator D2, the output terminal of the second comparator D2 may control the fifth switch unit 221 to be in conduction. When the voltage of the first input terminal of the second comparator D2 is less than the voltage of the second input terminal of the second comparator D2, the output terminal of the second comparator D2 may control the fifth switch unit 221 to be in disconnection. Therefore, in the static display stage, the second control unit 22 may be controlled to be in conduction and disconnection through the second reference voltage signal of the second reference voltage signal terminal Vr' and the potential signal of the first terminal of the storage capacitor C2.

Figure 4:
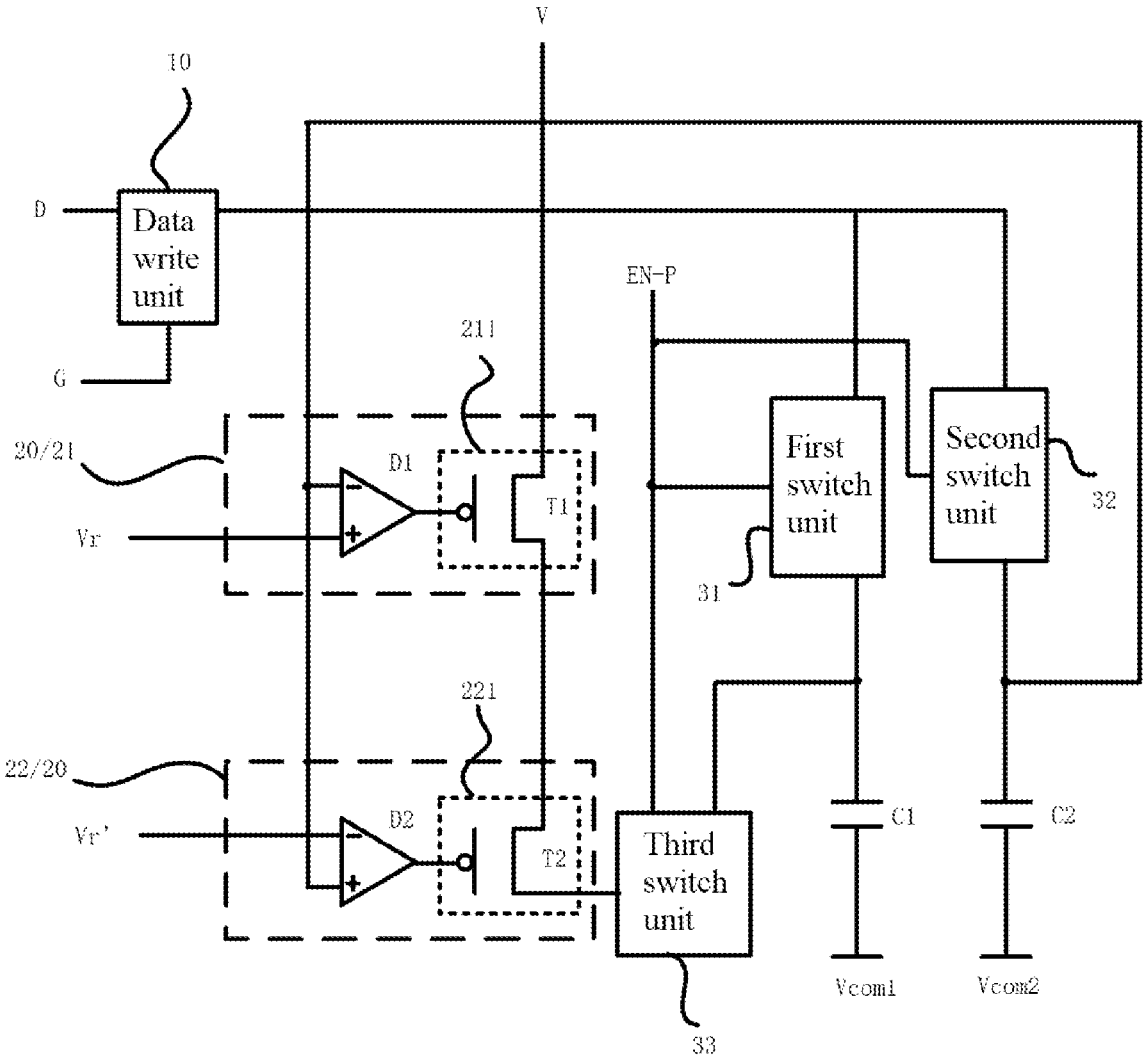
FIG. 4 illustrates a circuit schematic of another pixel circuit according to various embodiments of the present disclosure.

FIG. 4 illustrates a circuit schematic of another pixel circuit according to various embodiments of the present disclosure. Referring to FIG. 4, optionally, the fourth switch unit 211 may include a first transistor T1, the fifth switch unit 221 may include a second transistor T2, and the first transistor T1 and the second transistor T2 may both be P-type transistors.

The gate electrode of the first transistor T1 may be electrically connected to the output terminal of the first comparator D1; the first electrode of the first transistor T1 may be electrically connected to the first voltage signal terminal V; the second electrode of the first transistor T1 may be electrically connected to the first electrode of the second transistor T2; the gate electrode of the second transistor T2 may be electrically connected to the output terminal of the second comparator D2; and the second electrode of the second transistor T2 may be electrically connected to the third switch unit 33.

When the voltage of the first input terminal of the first comparator D1 is greater than the voltage of the second input terminal of the first comparator D1, the output terminal of the first comparator D1 may output a low-level signal; and when the voltage of the first input terminal of the first comparator D1 is less than the voltage of the second input terminal of the first comparator D1, the output terminal of the first comparator D1 may output a high-level signal.

When the voltage of the first input terminal of the second comparator D2 is greater than the voltage of the second input terminal of the second comparator D2, the output terminal of the second comparator D2 may output a low-level signal; and when the voltage of the first input terminal of the second comparator D2 is less than the voltage of the second input terminal of the second comparator D2, the output terminal of the second comparator D2 may output a high-level signal.

For example, referring to FIG. 4, in the pixel circuit provided in one embodiment, the fourth switch unit 211 may include the first transistor T1, and the fifth switch unit 221 may include the second transistor T2, where the first transistor T1 and the second transistor T2 may both be P-type transistors.

The gate electrode of the first transistor T1 may be electrically connected to the output terminal of the first comparator D1. When the voltage of the first input terminal of the first comparator D1 is greater than the voltage of the second input terminal of the first comparator D1, the output terminal of the first comparator D1 may output a low-level signal, and the first transistor T1 may be in conduction. When the voltage of the first input terminal of the first comparator D1 is less than the voltage of the second input terminal of the first comparator D1, the output terminal of the first comparator D1 may output a high-level signal, and the first transistor T1 may be in disconnection.

The gate electrode of the second transistor T2 may be electrically connected to the output terminal of the second comparator D2. When the voltage of the first input terminal of the second comparator D2 is greater than the voltage of the second input terminal of the second comparator D2, the output terminal of the second comparator D2 may output a low-level signal, and the second transistor T2 may be in conduction. When the voltage of the first input terminal of the second comparator D2 is less than the voltage of the second input terminal of the second comparator D2, the output terminal of the second comparator D2 may output a high-level signal, and the second transistor T2 may be in disconnection.

The first electrode of the first transistor T1 may be electrically connected to the first voltage signal terminal V, the second electrode of the first transistor T1 may be electrically connected to the first electrode of the second transistor T2, and the second electrode of the second transistor T2 may be electrically connected to the third switch unit 33. When the first transistor T1 and the second transistor T2 are both in conduction, the first voltage signal terminal V may transmit the first voltage signal to the third switch unit 33. When the third switch unit 33 is in conduction, the first voltage signal terminal V may transmit the first voltage signal to the liquid crystal capacitor C1. When any one or both of the first transistor T1 and the second transistor T2 is in disconnection, the first voltage signal of the first voltage signal terminal V cannot be transmitted to the third switch unit 33.

It should be noted that FIG. 4 exemplarily shows that the first transistor T1 and the second transistor T2 are P-type transistors. FIG. 4 exemplarily shows the circuit structures of the first comparator and the second comparator when the first transistor T1 and the second transistor T2 are P-type transistors. The P-type transistor is in conduction under the control of a low-level signal, and in disconnection under the control of a high-level signal. In some alternative embodiments, the first transistor T1 and the second transistor T2 may also be N-type transistors. The N-type transistor is in conduction under the control of a high-level signal and in disconnection under the control of a low-level signal. At this point, the circuit structures of the first comparator and the second comparator may also be changed accordingly, which may not be limited according to various embodiments of the present disclosure.

Figure 5:
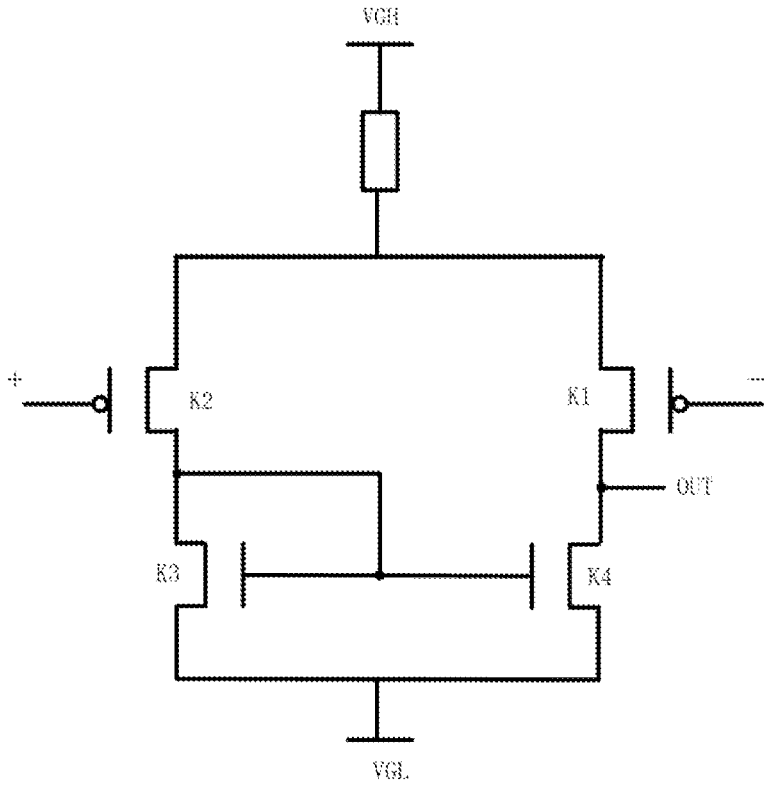
FIG. 5 illustrates a circuit schematic of a comparator according to various embodiments of the present disclosure.

Optionally, FIG. 5 illustrates a circuit schematic of a comparator according to various embodiments of the present disclosure. The circuit structures of the first comparator D1 and the second comparator D2 may refer to FIG. 5. The comparator may include a first switch K1, a second switch K2, a third switch K3, and a fourth switch K4. The control terminal of the first switch K1 may be electrically connected with the first input terminal; the first terminal of the first switch K1 may be electrically connected with a high potential signal; the second terminal of the first switch K1 may be electrically connected to the output terminal; the control terminal of the second switch K2 may be electrically connected to the second input terminal; the first terminal of the second switch K2 may be electrically connected to a high-potential signal; the second terminal of the second switch K2 may be electrically connected to the first terminal of the third switch K3, the control terminal of the third switch K3, and the control terminal of the fourth switch K4; the second terminal of the third switch K3 may be electrically connected to a low potential signal; the first terminal of the fourth switch K4 may be electrically connected to the output terminal; and the second terminal of the fourth switch K4 may be electrically connected with a low potential signal.

When the voltage of the first input terminal of the comparator is greater than the voltage of the second input terminal of the comparator, the first switch K1 may be turned off for disconnection, the second switch K2, the third switch K3, and the fourth switch K4 may be turned on for conduction; and the output terminal of the comparator may output a low potential signal. When the voltage of the first input terminal of the comparator is less than the voltage of the second input terminal of the comparator, the second switch K2, the third switch K3, and the fourth switch K4 may be turned off for disconnection, the first switch K1 may be turned on for conduction, and the output terminal of the comparator may output a high potential signal.

It should be noted that FIG. 5 exemplarily shows a circuit structure of the comparator. In other embodiments of the present disclosure, the first comparator D1 and the second comparator D2 may also use other circuit structures, which may not be described in detail herein.

Figure 6:
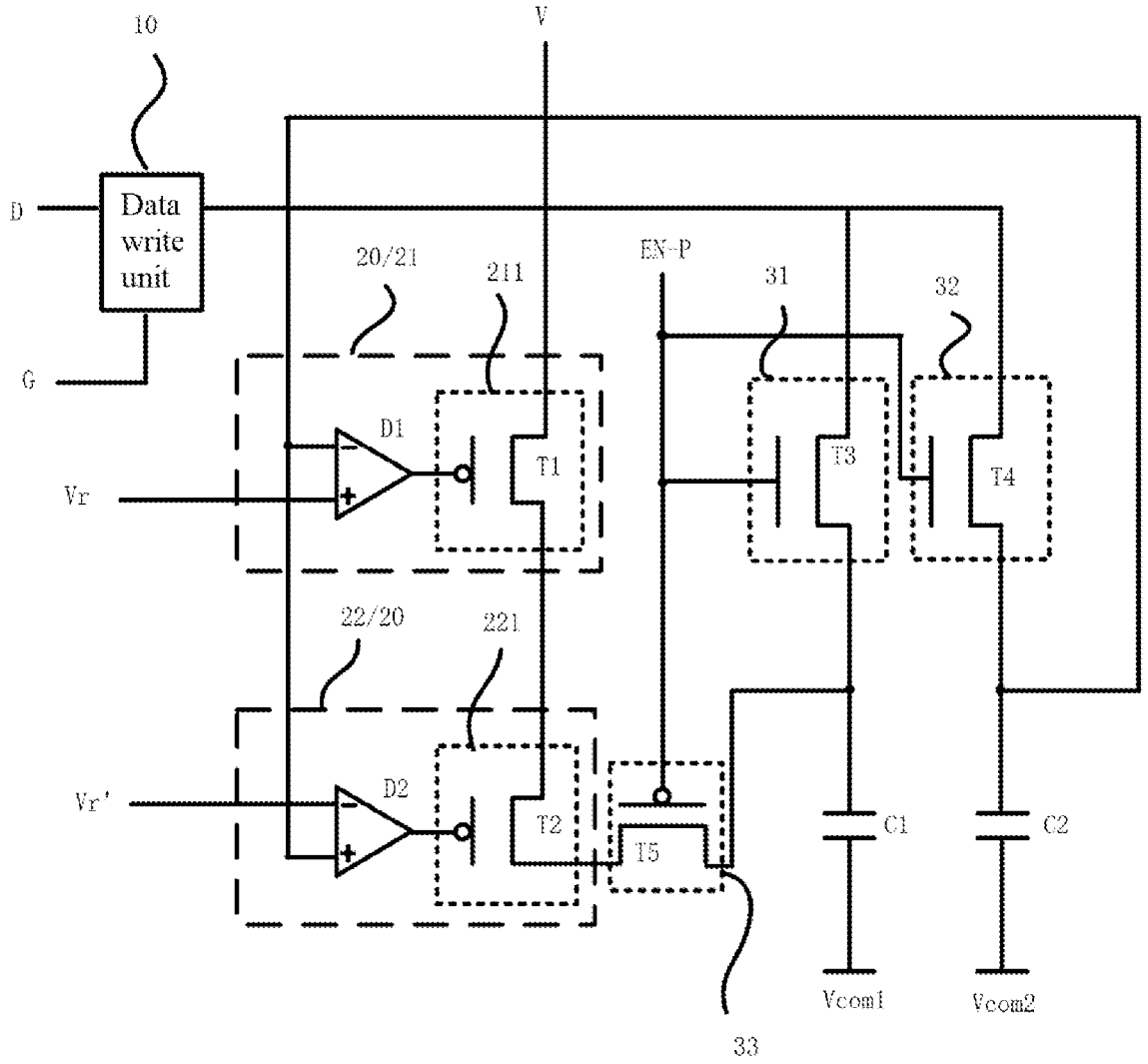
FIG. 6 illustrates a circuit schematic of another pixel circuit according to various embodiments of the present disclosure.

FIG. 6 illustrates a circuit schematic of another pixel circuit according to various embodiments of the present disclosure. Referring to FIG. 6, the first switch unit 31 may include a third transistor T3, the second switch unit 32 may include a fourth transistor T4, and the third switch unit 33 may include a fifth transistor T. The third transistor T3 and the fourth transistor T4 may be N-type transistors, and a fifth transistor T5 may be a P-type transistor. The gate electrode of the third transistor T3, the gate electrode of the fourth transistor T4 and the gate electrode of the fifth transistor T5 may all be electrically connected to the first control-signal terminal EN-P. When the signal of the first control-signal terminal EN-P is a low-level signal, the third transistor T3 and the fourth transistor T4 may be in conduction, and the fifth transistor T5 may be in disconnection. When the signal of the first control-signal terminal EN-P is a high-level signal, the third transistor T3 and the fourth transistor T4 may be in disconnection, and the fifth transistor T5 may be in conduction.

It should be noted that, FIG. 6 exemplarily shows that the third transistor T3 and the fourth transistor T4 are N-type transistors, and the fifth transistor T5 is a P-type transistor. In other embodiments of the present disclosure, the third transistor T3 and the fourth transistor T4 may be P-type transistors, and the fifth transistor T5 may be an N-type transistor. At this point, when the signal of the first control-signal terminal EN-P is a high-level signal, the third transistor T3 and the fourth transistor T4 may be in conduction, and the fifth transistor T5 may be in disconnection; and when the signal of the first control-signal terminal EN-P is a low-level signal, the third transistor T3 and the fourth transistor T4 may be in disconnection, and the fifth transistor T5 may be in conduction.

Figure 7:
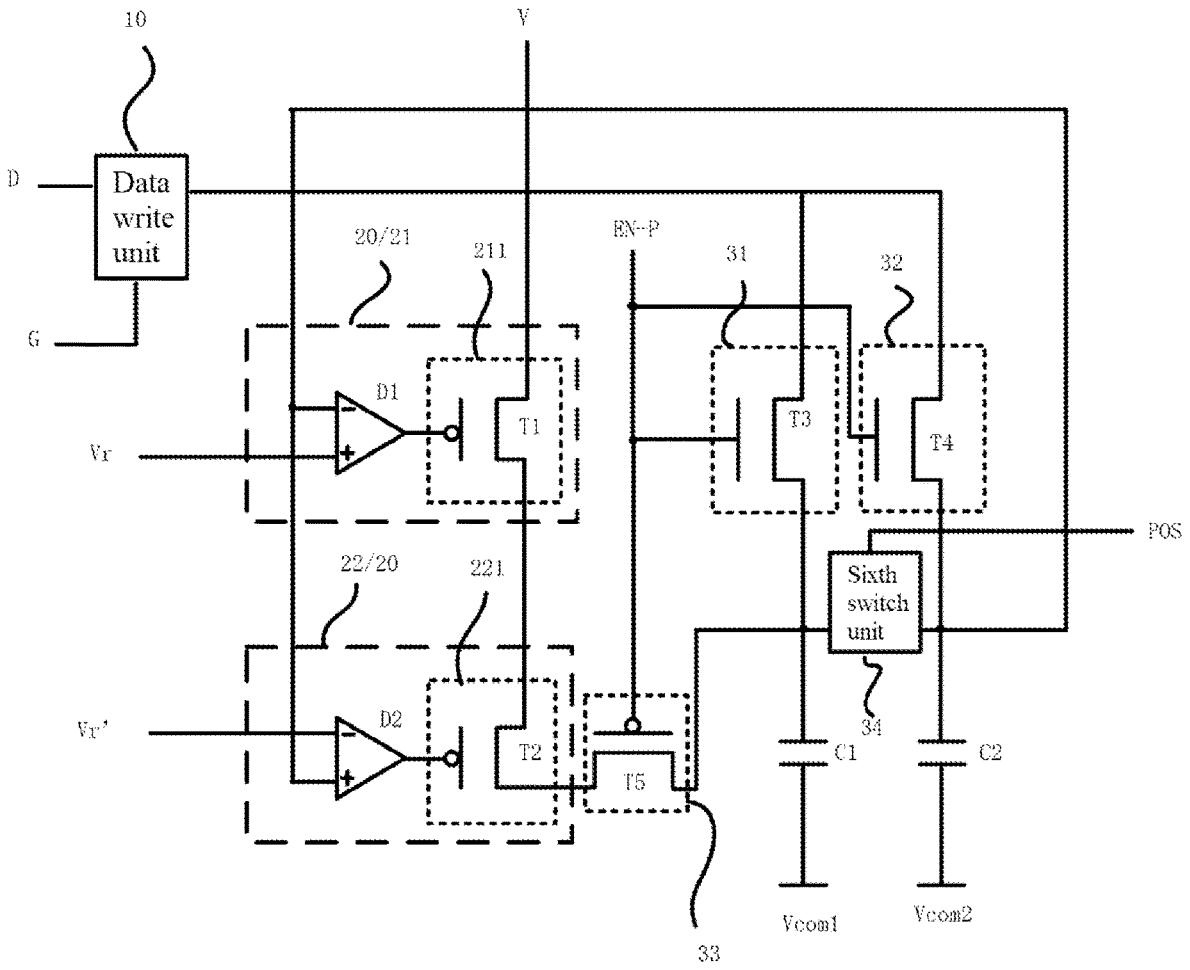
FIG. 7 illustrates a circuit schematic of another pixel circuit according to various embodiments of the present disclosure.

FIG. 7 illustrates a circuit schematic of another pixel circuit according to various embodiments of the present disclosure. Referring to FIG. 7, optionally, the pixel circuit may further include a sixth switch unit 34, the control terminal of the sixth switch unit 34 may be electrically connected to the second control-signal terminal POS (point-of-sale), the first terminal of the sixth switch unit 34 may be electrically connected to the first terminal of the liquid crystal capacitor C1, and the second terminal of the sixth switch unit 34 may be electrically connected to the first terminal of the storage capacitor C2.

The static display stage may include a first polarity display stage and a second polarity display stage that are alternately performed.

In the first polarity display stage, the first voltage signal transmitted to the liquid crystal capacitor C1 via the first voltage signal terminal V may have a positive polarity, and the sixth switch unit 34 may be turned on for conduction.

In the second polarity display stage, the first voltage signal transmitted to the liquid crystal capacitor C1 via the first voltage signal terminal V may have a negative polarity, and the sixth switch unit 34 may be turned off for disconnection.

For example, referring to FIG. 7, when the pixel circuit provided in one embodiment is in the static display stage, the static display stage may include the first polarity display stage and the second polarity display stage that are alternately performed. In the first polarity display stage, the first voltage signal transmitted to the liquid crystal capacitor C1 via the first voltage signal terminal V may have a positive polarity; and in the second polarity display stage, the first voltage signal transmitted to the liquid crystal capacitor C1 via the first voltage signal terminal V may have a negative polarity, which may realize the polarity reversal of the voltage difference between two terminals of the liquid crystal capacitor C1, and effectively prevent the liquid crystal polarization during the static display stage.

The pixel circuit may further include the sixth switch unit 34. The control terminal of the sixth switch unit 34 may be electrically connected to the second control-signal terminal POS, the first terminal of the sixth switch unit 34 may be electrically connected to the first terminal of the liquid crystal capacitor C1, and the second terminal of the sixth switch unit 34 may be electrically connected to the first terminal of the storage capacitor C2. In the first polarity display stage, the sixth switch unit 34 may be turned on for conduction, and the storage capacitor C2 may be charged through the first voltage signal terminal V, which may effectively avoid the leakage of the storage capacitor C2 after the long time static display, causing the voltage of the first terminal of the storage capacitor C2 to deviate from the original grayscale data voltage, such that the deviation may be prevented from affecting the determination of conduction and disconnection of the voltage compensation unit 20. In the second polarity display stage, the first voltage signal transmitted to the liquid crystal capacitor C1 via the first voltage signal terminal V may have a negative polarity, and the sixth switch unit 34 may be turned off for disconnection, which may prevent the first voltage signal transmitted to the liquid crystal capacitor C1 via the first voltage signal terminal V from affecting the storage capacitor C2 during the second polarity display stage.

Figure 8:
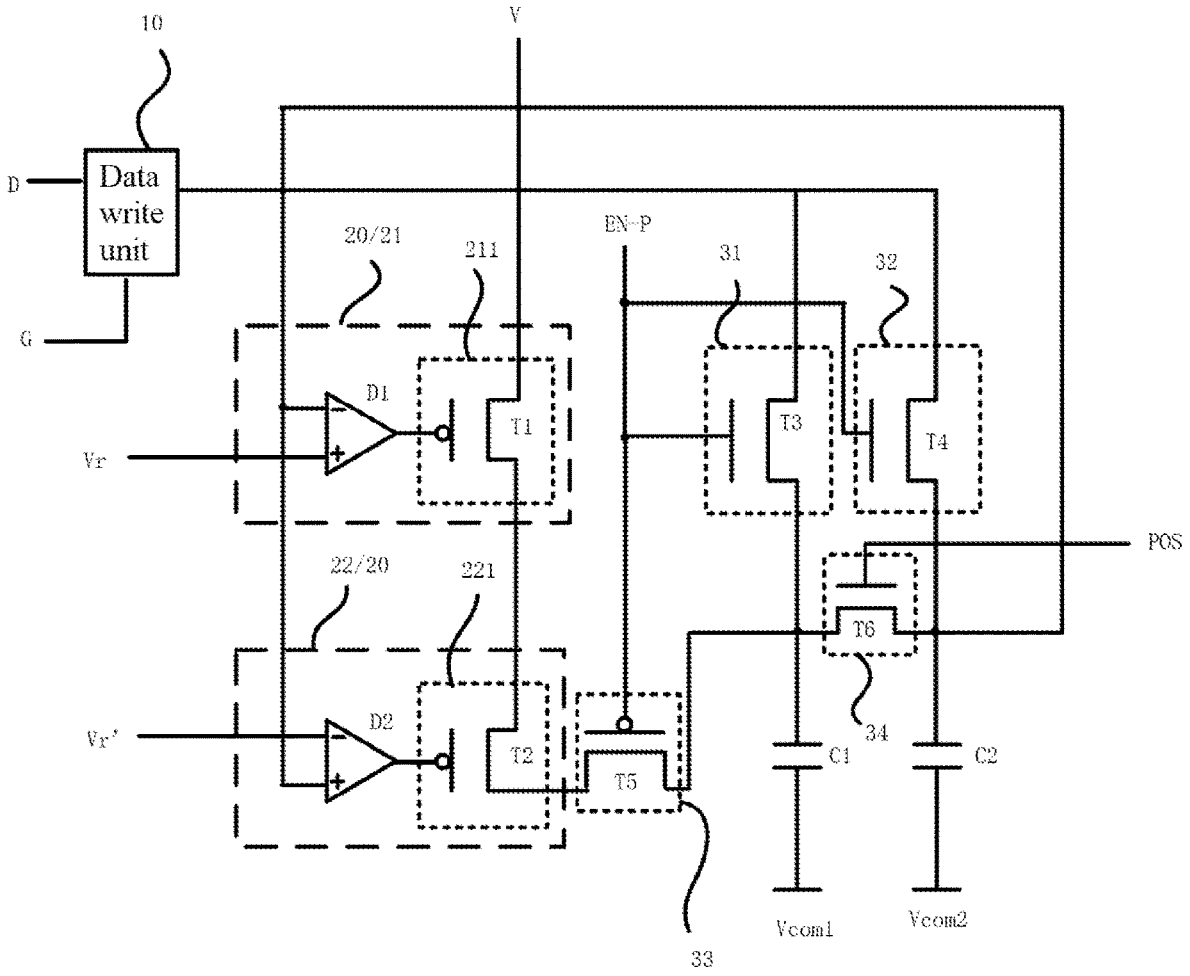
FIG. 8 illustrates a circuit schematic of another pixel circuit according to various embodiments of the present disclosure.

FIG. 8 illustrates a circuit schematic of another pixel circuit according to various embodiments of the present disclosure. Referring to FIG. 8, optionally, the sixth switch unit 34 may include a sixth transistor T6. The gate electrode of the sixth transistor T6 may be electrically connected to the second control-signal terminal POS, the first electrode of the sixth transistor T6 may be electrically connected to the first terminal of the liquid crystal capacitor C1, and the second terminal of the sixth transistor T6 may be electrically connected to the first terminal of the storage capacitor C2.

For example, referring to FIG. 8, the sixth switch unit 34 may include the sixth transistor T6. The gate electrode of the sixth transistor T6 may be electrically connected to the second control-signal terminal POS, the first electrode of the sixth transistor T6 may be electrically connected to the first terminal of the liquid crystal capacitor C1, the second terminal of the sixth transistor T6 may be electrically connected to the first terminal of the storage capacitor C2, and the conduction and disconnection of the sixth transistor T6 may be controlled by the signal of the second control-signal terminal POS.

Optionally, referring to FIG. 8, the sixth transistor T6 may be an N-type transistor, and the sixth transistor T6 may be in conduction under the control of a high-level signal, and in disconnection under the control of a low-level signal. In other embodiments of the present disclosure, the sixth transistor T6 may also be a P-type transistor. At this point, the sixth transistor T6 may be in conduction under the control of a low-level signal, and in disconnection under the control of a high-level signal.

Figure 9:
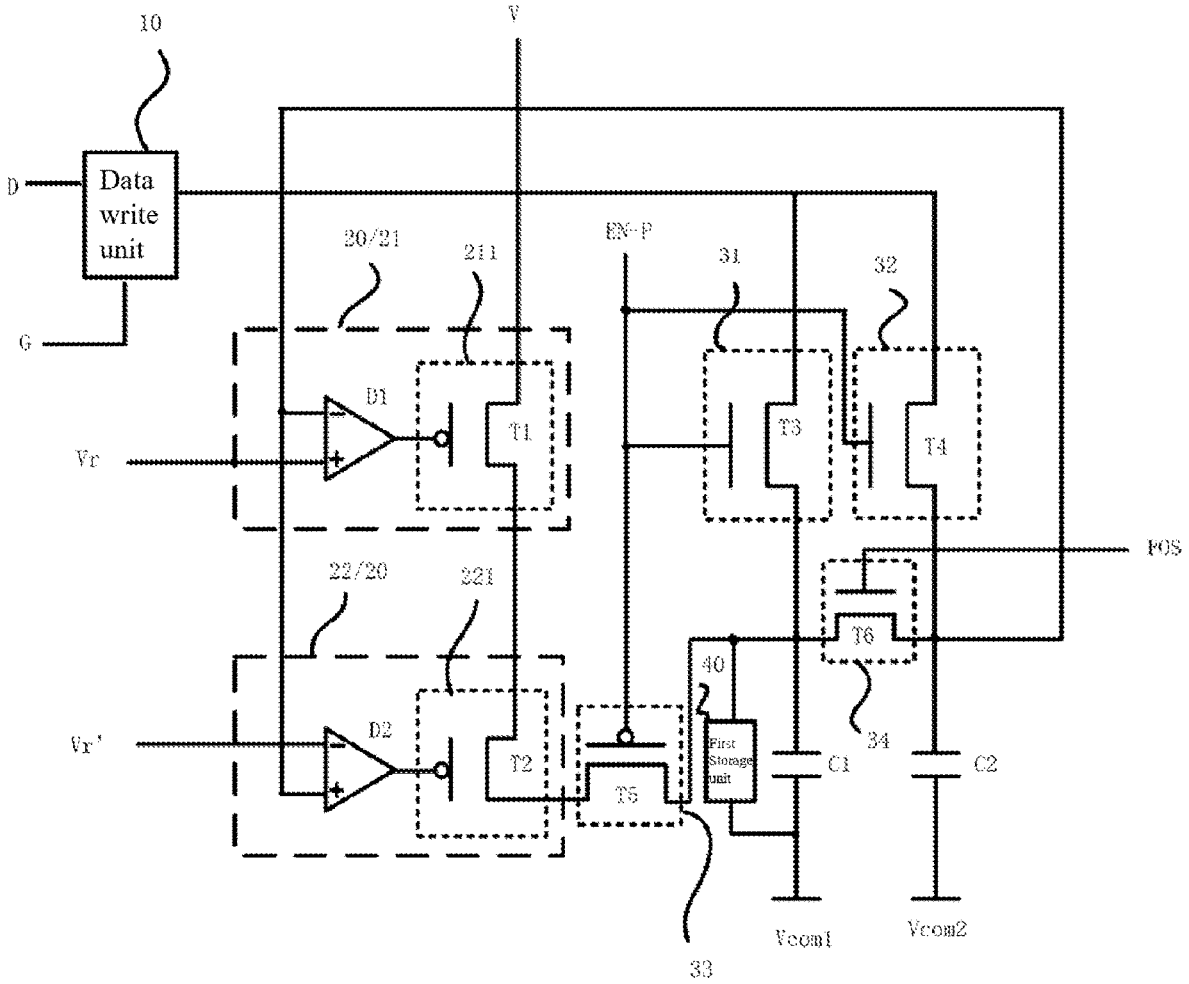
FIG. 9 illustrates a circuit schematic of another pixel circuit according to various embodiments of the present disclosure.

FIG. 9 illustrates a circuit schematic of another pixel circuit according to various embodiments of the present disclosure. Referring to FIG. 9, optionally, the pixel circuit may further include a first storage unit 40, the first terminal of the first storage unit 40 may be electrically connected to the first terminal of the liquid crystal capacitor C1, and the second terminal of the first storage unit 40 may be electrically connected to the second terminal of the liquid crystal capacitor C1.

For example, referring to FIG. 9, the pixel circuit provided in one embodiment may further include the first storage unit 40, and two terminals of the first storage unit 40 may be respectively connected to two terminals of the liquid crystal capacitor C1. The arrangement of the first storage unit 40 may effectively prevent the leakage of the liquid crystal capacitor C1 from causing the voltage of the first terminal of the liquid crystal capacitor C1 to deviate from the original grayscale data voltage, thereby improving the display effect of the display panel.

Figure 10:
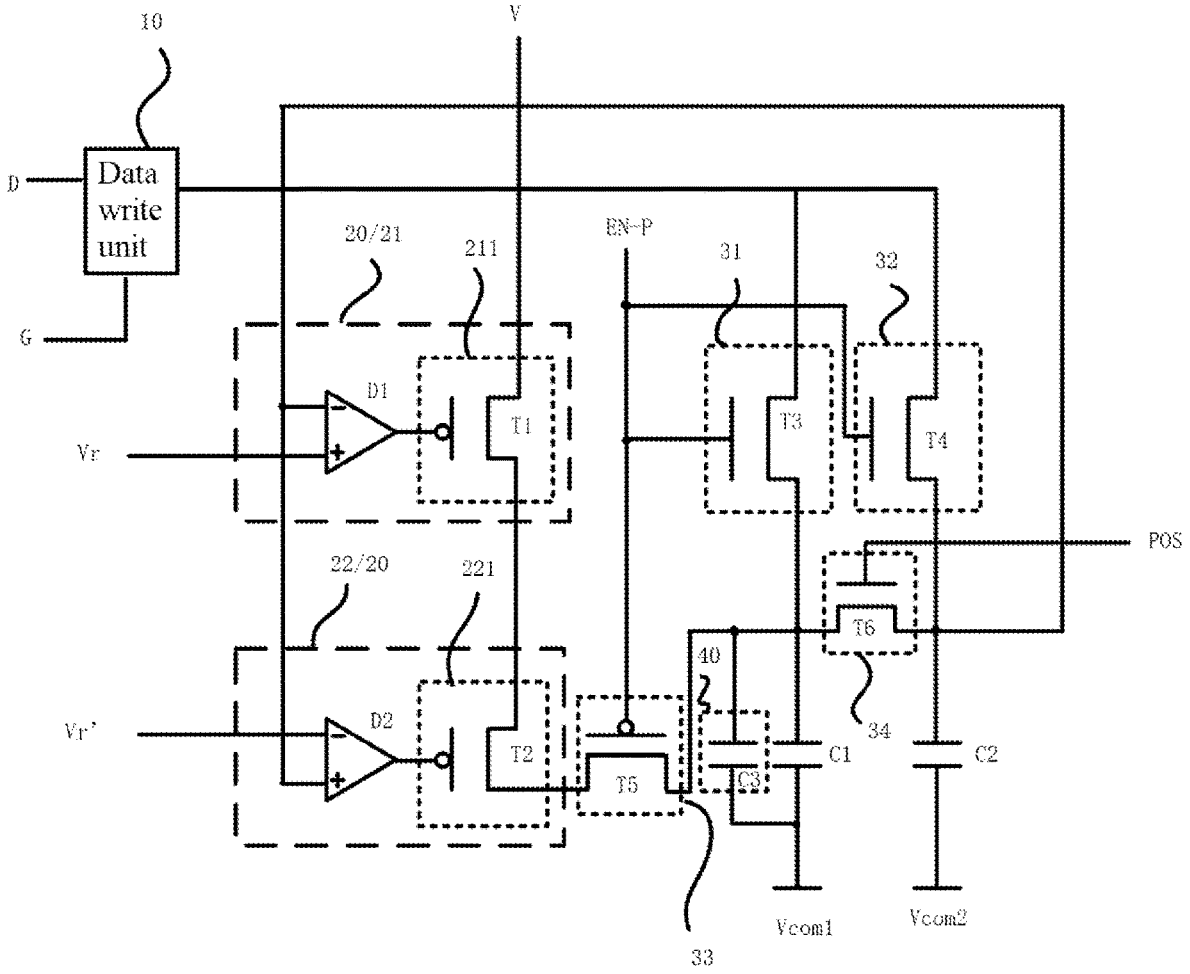
FIG. 10 illustrates a circuit schematic of another pixel circuit according to various embodiments of the present disclosure.

FIG. 10 illustrates a circuit schematic of another pixel circuit according to various embodiments of the present disclosure. Referring to FIG. 10, optionally, the first storage unit 40 may include a first capacitor C3, the first terminal of the first capacitor C3 may be electrically connected to the first terminal of the liquid crystal capacitor C1, and the second terminal of the first capacitor C3 may be electrically connected to the second terminal of the liquid crystal capacitor C1.

For example, referring to FIG. 10, the first storage unit 40 may include the first capacitor C3, and two terminals of the first capacitor C3 may be respectively connected to two terminals of the liquid crystal capacitor C1. When charging of the liquid crystal capacitor C1, the first capacitor C3 and the liquid crystal capacitor C1 may be charged to a same potential. The first capacitor C3 may be used to stabilize the voltage of the first terminal of the liquid crystal capacitor C1. Therefore, the arrangement of the first storage unit 40 may effectively prevent the leakage of the liquid crystal capacitor C1 from causing the voltage of the first terminal of the liquid crystal capacitor C1 to deviate from the original grayscale data voltage.

Figure 11:
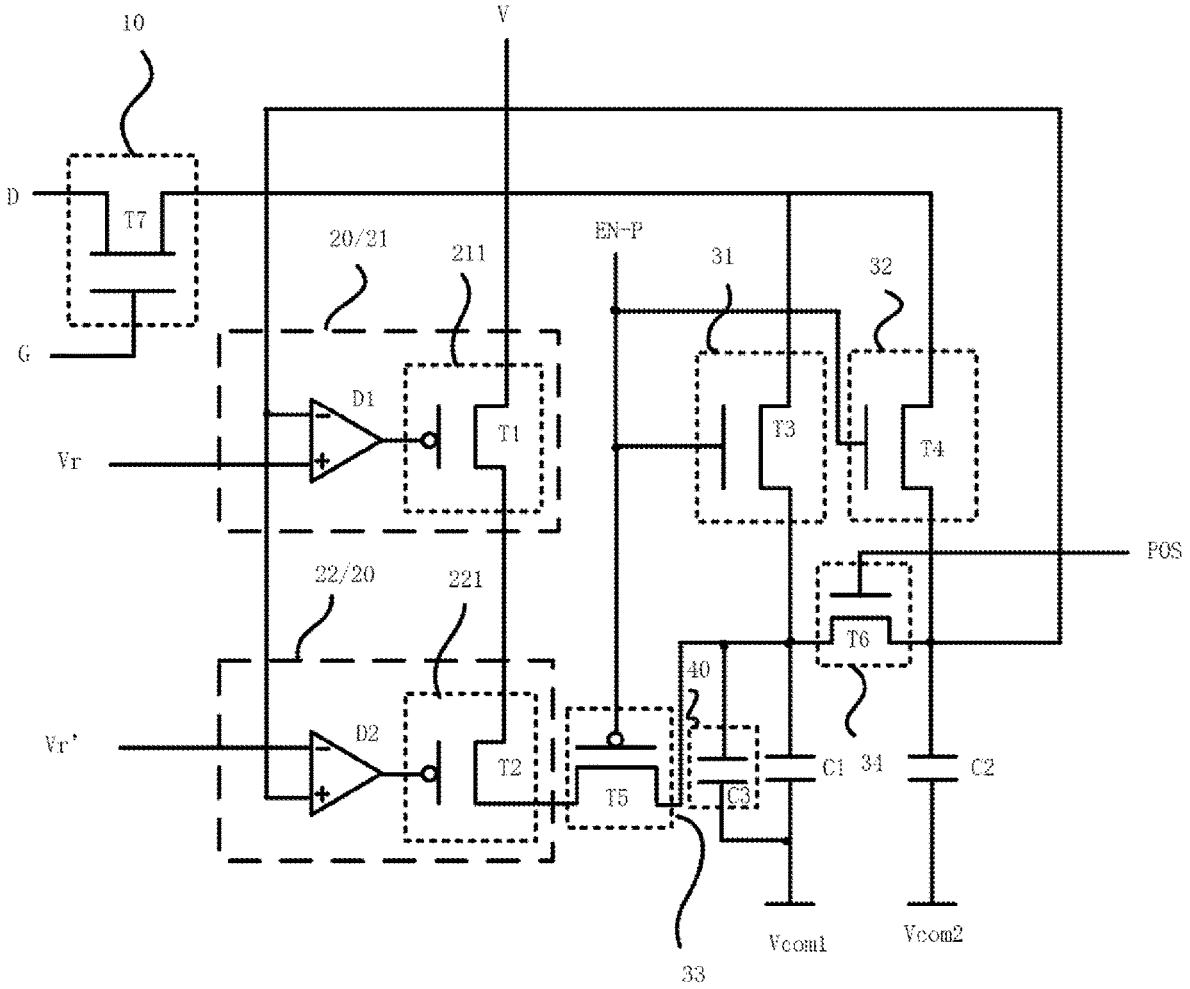
FIG. 11 illustrates a circuit schematic of another pixel circuit according to various embodiments of the present disclosure.

FIG. 11 illustrates a circuit schematic of another pixel circuit according to various embodiments of the present disclosure. Referring to FIG. 11, optionally, the data write unit 10 may include a seventh transistor T7, the gate electrode of the seventh transistor T7 may be electrically connected to a scan line G, the first electrode of the seventh transistor T7 may be electrically connected to a data line D, and the second electrode of the seventh transistor T7 may be electrically connected to each of the first switch unit 31 and the second switch unit 32.

For example, referring to FIG. 11, in the pixel circuit provided in one embodiment, the data write unit 10 may include the seventh transistor T7, the gate electrode of the seventh transistor T7 may be electrically connected to the scan line G, the first electrode of the seventh transistor T7 may be electrically connected to the data line D, the second electrode of the seventh transistor T7 may be electrically connected to each of the first switch unit 31 and the second switch unit 32, and the conduction and disconnection of the seventh transistor T7 may be controlled by the scan line G. When the seventh transistor T7 is in conduction, the data voltage signal on the data line D may be transmitted to the liquid crystal capacitor C1 and the storage capacitor C2.

It should be noted that, FIG. 11 exemplarily shows that the seventh transistor T7 is an N-type transistor, when the scan line G provides a high-level signal, the seventh transistor T7 may be in conduction, and when the scan line G provides a low-level signal, the seventh transistor T7 may be in disconnection. In other embodiments of the present disclosure, the seventh transistor T7 may also be a P-type transistor. At this point, the seventh transistor T7 may be in conduction under the control of a low-level signal, and in disconnection under the control of a high-level signal.

Figure 12:
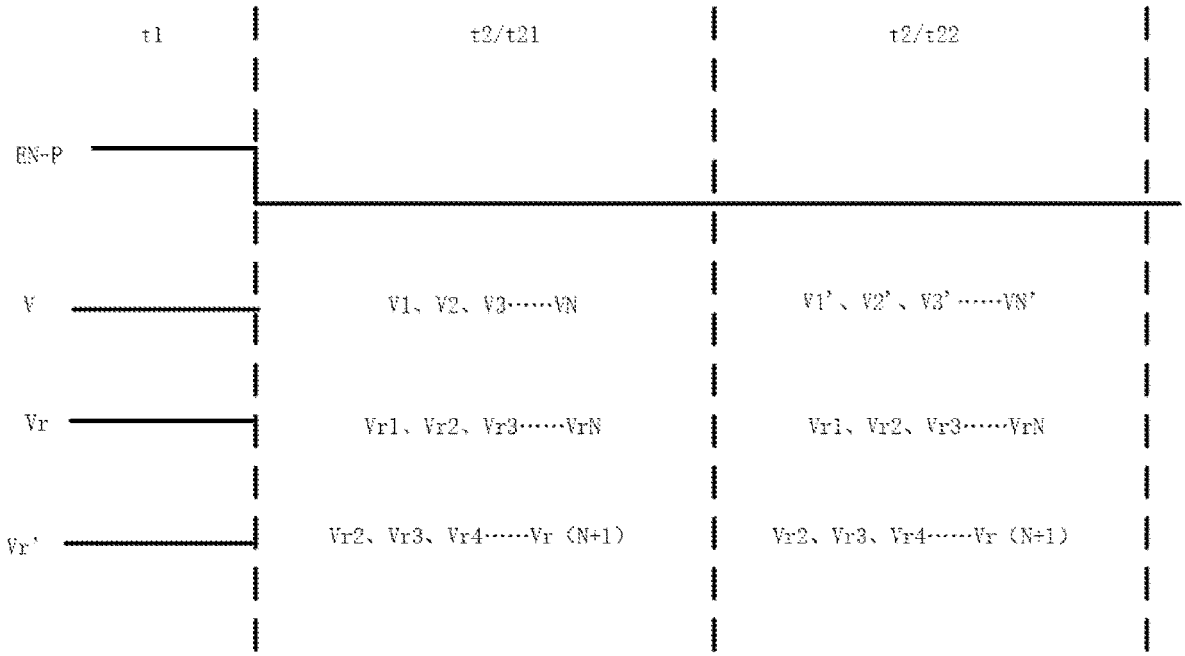
FIG. 12 illustrates a drive sequence diagram of a pixel circuit according to various embodiments of the present disclosure.

FIG. 12 illustrates a drive sequence diagram of the pixel circuit according to various embodiments of the present disclosure. Referring to FIGS. 1 and 12, a drive method of the pixel circuit may be provided in one embodiment. The pixel circuit may include the data write unit 10, the voltage compensation unit 20, the first switch unit 31, the second switch unit 32, the third switch unit 33, the liquid crystal capacitor C1, and the storage capacitor C2.

The data write unit 10 may be electrically connected to the first terminal of the first switch unit 31 and the first terminal of the second switch unit 42.

The second terminal of the first switch unit 31 may be electrically connected to the first terminal of the liquid crystal capacitor C1, and the control terminal of the first switch unit 31 may be electrically connected to the first control-signal terminal EN-P.

The second terminal of the second switch unit 32 may be electrically connected to the first terminal of the storage capacitor C2, and the control terminal of the second switch unit 32 may be electrically connected to the first control-signal terminal EN-P.

The first terminal of the third switch unit 33 may be electrically connected to the voltage compensation unit 20, the second terminal of the third switch unit 33 may be electrically connected to the first terminal of the liquid crystal capacitor C1, and the control terminal of the third switch unit 33 may be electrically connected to the first control-signal terminal EN-P.

The voltage compensation unit 20 may be electrically connected to the first terminal of the storage capacitor C2, and the voltage compensation unit 20 may be electrically connected to each of the first reference voltage signal terminal Vr, the second reference voltage signal terminal Vr', and the first voltage signal terminal V.

The second terminal of the liquid crystal capacitor C1 may be electrically connected to the first common voltage signal terminal Vcom1.

The second terminal of the storage capacitor C2 may be electrically connected to the second common voltage signal terminal Vcom2.

The method for driving the pixel circuit provided in one embodiment may include:

a dynamic display stage t1, where the first switch unit 31 and the second switch unit 32 may be turned on for conduction, the third switch unit 33 may be turned off for disconnection, and the data write unit 10 may transmit the data voltage signal on the data line D to the liquid crystal capacitor C1 and the storage capacitor C2; and a static display stage t2, where the first switch unit 31 and the second switch unit 32 may be turned off for disconnection, and the third switch unit 33 may be turned on for conduction; the voltage compensation unit 20 may be controlled to be in conduction through the first reference voltage signal of the first reference voltage signal terminal Vr, the second reference voltage signal of the second reference voltage signal terminal Vr', and the potential signal of the first terminal of the storage capacitor C2; and the first voltage signal terminal Vr may transmit the first voltage signal to the liquid crystal capacitor C1 through the voltage compensation unit 20.

For example, the method for driving the pixel circuit in one embodiment may include the dynamic display stage t1 and the static display stage t2. In the dynamic display stage t1, the first switch unit 31 and the second switch unit 32 may be turned on for conduction and the third switch unit 33 may be turned off for disconnection by controlling the signal of the first control-signal terminal EN-P; and the data write unit 10 may transmit the data voltage signal on the data line D to the liquid crystal capacitor C1 and the storage capacitor C2. The display panel may generate a corresponding liquid crystal deflection electric field, based on the liquid crystal capacitor C1, according to the data voltage signal on the data line D; and the storage capacitor C2 may store the data voltage signal on the data line D simultaneously. In the static display stage t2, the first switch unit 31 and the second switch unit 32 may be turned off for disconnection and the third switch unit 33 may be turned on for conduction by controlling the signal of the first control-signal terminal EN-P; the voltage compensation unit 20 may be controlled to be in conduction through the first reference voltage signal of the first reference voltage signal terminal Vr, the second reference voltage signal of the second reference voltage signal terminal Vr', and the potential signal of the first terminal of the storage capacitor C2; the first voltage signal terminal Vr may transmit the first voltage signal to the liquid crystal capacitor C1 through the voltage compensation unit 20; and the display panel may generate a corresponding liquid crystal deflection electric field, based on the liquid crystal capacitor C1, according to the first voltage signal provided by the first voltage signal terminal Vr. At this point, the first voltage signal provided by the first voltage signal terminal Vr may correspond to the data voltage of each display grayscale, thereby supporting the color picture display in the static display stage.

Moreover, in the existing technology, the storage circuit may be disposed to store the data voltage in the normal display stage, and the data voltage may be directly provided to the liquid crystal capacitor in the static display stage. In the static display stage, the storage circuit may have leakage, and the data voltage provided by the storage circuit may inevitably deviate from the original grayscale data voltage with the time accumulation, which affects the display effect of the display panel in the static display stage. According to the pixel circuit provided in one embodiment, the display panel may generate a corresponding liquid crystal deflection electric field, based on the liquid crystal capacitor C1, according to the first voltage signal provided by the first voltage signal terminal Vr, and the data voltage signal may not be provided to the liquid crystal capacitor via the storage circuit. Therefore, the situation that the data voltage signal provided by the storage circuit to the liquid crystal capacitor deviates from the data voltage of the original grayscale due to the time accumulation in the static display stage may not occur, which may be beneficial for improving the display effect of the display panel.

Referring to FIGS. 1 and 12, optionally, the static display stage t2 may include a first polarity display stage t21 and a second polarity display stage t22 that are alternately performed. Each of the first polarity display stage t21 and the second polarity display stage t22 may include at least one frame of display period.

In the first polarity display stage t21, the first voltage signal transmitted to the storage capacitor C2 via the first voltage signal terminal V may have a positive polarity.

In one frame of display period at the first polarity display stage t21, all levels of the reference voltage signals in the reference voltage signal group may be sequentially inputted to the first reference voltage signal terminal Vr and the second reference voltage signal terminal Vr'; and all levels of the first voltage signals in the first voltage signal group may be sequentially inputted to the first voltage signal terminal V. The reference voltage signal group may include N+1 levels of the reference voltage signals which increase sequentially, that is, Vr1, Vr2, Vr3 . . . VrN, and Vr(N+1). The first voltage signal group may include N levels of the first voltage signals which increase sequentially, that is, V1, V2, V3 . . . VN.

When the first reference voltage signal terminal Vr is inputted with an n-th level reference voltage signal Vrn, the second reference voltage signal terminal Vr' may be inputted with an (n+1)-th level reference voltage signal Vr(n+1), and the first voltage signal terminal V may be inputted with an n-th level first voltage signal Vn. The voltage of the n-th level first voltage signal Vn may be between the voltage of the n-th level reference voltage signal Vrn and the voltage of the (n+1)-th level reference voltage signal Vr(n+1), where $1 \leq n \leq N$, and n and N are both positive integers. That is, $Vr1<V1<Vr2<V2<Vr3 \ldots VrN<VN<Vr(N+1)$.

In the second polarity display stage t22, the first voltage signal transmitted to the storage capacitor C2 via the first voltage signal terminal V may have a negative polarity.

In one frame of display period at the second polarity display stage t22, all levels of the reference voltage signals in the reference voltage signal group may be sequentially inputted to the first reference voltage signal terminal Vr and the second reference voltage signal terminal Vr'; and all levels of the first voltage signals in the second voltage signal group may be sequentially inputted to the first voltage signal terminal V. The reference voltage signal group may include N+1 levels of the reference voltage signals which increase sequentially, that is, Vr1, Vr2, Vr3 . . . VrN, and Vr(N+1). The second voltage signal group may include N levels of the first voltage signals that decrease sequentially, that is, V1', V2', V3' . . . VN'.

When the first reference voltage signal terminal Vr is inputted with the n-th level reference voltage signal Vrn, the second reference voltage signal terminal Vr' may be inputted with the (n+1)-th level reference voltage signal Vr(n+1), and the first voltage signal terminal V may be inputted with the n-th level first voltage signal Vn'. The absolute voltage value of the n-th level first voltage signal Vn' may be between the voltage of the n-th level reference voltage signal Vrn and the voltage of the (n+1)-th level reference voltage signal Vr(n+1), where 1<n<N, and n and N are both positive integers.

The voltage of the n-th level first voltage signal Vn in the first voltage signal group may be same as the absolute voltage value of the n-th level first voltage signal Vn' in the second voltage signal group, such that Vr1|V1'|<Vr2|V2'|<Vr3 . . . VrN<|VN'|<Vr(N+1).

When a voltage of a first grayscale signal is greater than an m-th level reference voltage signal Vrm and less than an (m+1)-th level reference voltage signal Vr(m+1), the m-th level first voltage signal Vm may be transmitted to the liquid crystal capacitor C1 through the voltage compensation unit 20, the voltage of the first grayscale signal may be the voltage of the first terminal of the storage capacitor C2 in the last frame of display period of the previous dynamic display stage t1 connected to the static display stage t2, where 1≤m≤N, and m is a positive integer.

When the dynamic display stage t1 is switched into the static display stage t2, the voltage of the first terminal of the storage capacitor C2 in the last frame of display period of the dynamic display stage t1 may be transmitted to the voltage compensation unit 20, and the voltage compensation unit 20 may be controlled to be in conduction and disconnection by such voltage and the signals of the first reference voltage signal terminal Vr and the second reference voltage signal terminal Vr'. Exemplarily, when the voltage of the first terminal of the storage capacitor C2 in the last frame of display period of the dynamic display stage t1 is greater than the m-th level reference voltage signal Vrm and less than the (m+1)-th level reference voltage signal Vr (m+1), the voltage compensation unit 20 may be in conduction. At this point, the m-th level first voltage signal Vm may be transmitted to the liquid crystal capacitor C1 through the voltage compensation unit 20. Therefore, at this point, the first voltage signal Vm provided by the first voltage signal terminal Vr may correspond to the voltage signal of the liquid crystal capacitor C1 in the last frame of display period of the dynamic display stage t1 when the dynamic display stage t1 is switched into the static display stage t2, thereby supporting the color picture display in the static display stage t2.

Referring to FIGS. 2 and 12, optionally, the voltage compensation unit 20 may include the first control unit 21 and the second control unit 22 that are electrically connected with each other.

The first control unit 21 may be electrically connected to the first reference voltage signal terminal Vr, the storage capacitor C2, and the first voltage signal terminal V.

The second control unit 22 may be electrically connected to the second reference voltage signal terminal Vr', the storage capacitor C2, and the third switch unit 33.

In the static display stage t2, the first control unit 21 may be controlled to be in conduction through the first reference voltage signal of the first reference voltage signal terminal Vr and the potential signal of the first terminal of the storage capacitor C2; the second control unit 22 may be controlled to be in conduction through the second reference voltage signal of the second reference voltage signal terminal Vr' and the potential signal of the first terminal of the storage capacitor C2; and the first voltage signal terminal V may transmit the first voltage signal to the liquid crystal capacitor C1 through the first control unit 21 and the second control unit 22.

For example, the voltage compensation unit 20 in the pixel circuit may include the first control unit 21 and the second control unit 22 that are electrically connected with each other. The first control unit 21 may be electrically connected to the first reference voltage signal terminal Vr and the storage capacitor C2; and the second control unit 22 may be electrically connected to the second reference voltage signal terminal Vr' and the storage capacitor C2. In the static display stage t2, the first control unit 21 may be controlled to be in conduction and disconnection through the first reference voltage signal of the first reference voltage signal terminal Vr and the potential signal of the first terminal of the storage capacitor C2; and the second control unit 22 may be controlled to be in conduction and disconnection through the second reference voltage signal of the second reference voltage signal terminal Vr' and the potential signal of the first terminal of the storage capacitor C2. The first control unit 21 may be electrically connected to the first voltage signal terminal V, and the second control unit 22 may be electrically connected to the third switch unit 33. When the first control unit 21 and the second control unit 22 are both in conduction, the first voltage signal terminal V may transmit the first voltage signal to the third switch unit 33 through the first control unit 21 and the second control unit 22; and when the third switch unit 33 is in conduction, the first voltage signal terminal V may transmit the first voltage signal to the liquid crystal capacitor C1.

Referring to FIGS. 3 and 12, optionally, the first control unit 21 may include the first comparator D1 and the fourth switch unit 211. The first input terminal of the first comparator D1 may be electrically connected to the storage capacitor C2, the second input terminal of the first comparator D1 may be electrically connected to the first reference voltage signal terminal Vr; the output terminal of the first comparator D1 may be electrically connected to the control terminal of the fourth switch unit 211; and the first terminal of the fourth switch unit 211 may be electrically connected to the first voltage signal terminal V.

The second control unit 22 may include the second comparator D2 and the fifth switch unit 221. The first input terminal of the second comparator D2 may be electrically connected to the second reference voltage signal terminal Vr'; the second input terminal of the second comparator D2 may be electrically connected to the storage capacitor C2; the output terminal of the second comparator D2 may be electrically connected to the control terminal of the fifth switch unit 221; the first terminal of the fifth switch unit 221 may be electrically connected to the second terminal of the fourth switch unit 211; and the second terminal of the fifth switch unit 221 may be electrically connected to the third switch unit 33.

When the voltage of the first input terminal of the first comparator D1 is greater than the voltage of the second input terminal of the first comparator D1, the output terminal of the first comparator D1 may control the fourth switch unit 211 to be turned on for conduction. When the voltage of the first input terminal of the first comparator D1 is less than the voltage of the second input terminal of the first comparator D1, the output terminal of the first comparator D1 may control the fourth switch unit 211 to be turned off for disconnection.

When the voltage of the first input terminal of the second comparator D2 is greater than the voltage of the second input terminal of the second comparator D2, the output terminal of the second comparator D2 may control the fifth switch unit 221 to be turned on for conduction. When the voltage of the first input terminal of the second comparator D2 is less than the voltage of the second input terminal of the second comparator D2, the output terminal of the second comparator D2 may control the fifth switch unit 221 to be turned off for disconnection.

For example, in the pixel circuit, the first control unit 21 may include the first comparator D1 and the fourth switch unit 211. The first input terminal of the first comparator D1 may be electrically connected to the storage capacitor C2; the second input terminal of the first comparator D1 may be electrically connected to the first reference voltage signal terminal Vr; and the output terminal of the first comparator D1 may be electrically connected to the control terminal of the fourth switch unit 211. When the voltage of the first input terminal of the first comparator D1 is greater than the voltage of the second input terminal of the first comparator D1, the output terminal of the first comparator D1 may control the fourth switch unit 211 to be turned on for conduction. When the voltage of the first input terminal of the first comparator D1 is less than the voltage of the second input terminal of the first comparator D1, the output terminal of the first comparator D1 may control the fourth switch unit 211 to be turned off for disconnection. Therefore, in the static display stage, it may implement that the first control unit 21 may be controlled to be in conduction and disconnection through the first reference voltage signal of the first reference voltage signal terminal Vr and the potential signal of the first terminal of the storage capacitor C2.

The second control unit 22 may include the second comparator D2 and the fifth switch unit 221. The first input terminal of the second comparator D2 may be electrically connected to the second reference voltage signal terminal Vr'; the second input terminal of the second comparator D2 may be electrically connected to the storage capacitor C2; the output terminal of the second comparator D2 may be electrically connected to the control terminal of the fifth switch unit 221; the first terminal of the fifth switch unit 221 may be electrically connected to the second terminal of the fourth switch unit 211; and the second terminal of the fifth switch unit 221 may be electrically connected to the third switch unit 33. When the voltage of the first input terminal of the second comparator D2 is greater than the voltage of the second input terminal of the second comparator D2, the output terminal of the second comparator D2 may control the fifth switch unit 221 to be turned on for conduction. When the voltage of the first input terminal of the second comparator D2 is less than the voltage of the second input terminal of the second comparator D2, the output terminal of the second comparator D2 may control the fifth switch unit 221 to be turned off for disconnection. Therefore, in the static display stage, it may implement that the second control unit 22 may be controlled to be in conduction and disconnection through the second reference voltage signal of the second reference voltage signal terminal Vr' and the potential signal of the first terminal of the storage capacitor C2.

Referring to FIGS. 4 and 12, optionally, the fourth switch unit 211 may include the first transistor T1, the fifth switch unit 221 may include the second transistor T2, and the first transistor T1 and the second transistor T2 may both be P-type transistors.

The gate electrode of the first transistor T1 may be electrically connected to the output terminal of the first comparator D1; the first electrode of the first transistor T1 may be electrically connected to the first voltage signal terminal V; the second electrode of the first transistor T1 may be electrically connected to the first electrode of the second transistor T2; the gate electrode of the second transistor T2 may be electrically connected to the output terminal of the second comparator D2; and the second pole of the second transistor T2 may be electrically connected to the third switch unit 33.

When the voltage of the first input terminal of the first comparator D1 is greater than the voltage of the second input terminal of the first comparator D1, the output terminal of the first comparator D1 may output a low-level signal; and when the voltage of the first input terminal of the first comparator D1 is less than the voltage of the second input terminal of the first comparator D1, the output terminal of the first comparator D1 may output a high-level signal.

When the voltage of the first input terminal of the second comparator D2 is greater than the voltage of the second input terminal of the second comparator D2, the output terminal of the second comparator D2 may output a low-level signal; and when the voltage of the first input terminal of the second comparator D2 is less than the voltage of the second input terminal of the second comparator D2, the output terminal of the second comparator D2 may output a high-level signal.

For example, in the pixel circuit, the fourth switch unit 211 may include the first transistor T1, and the fifth switch unit 221 may include the second transistor T2, where the first transistor T1 and the second transistor T2 may both be P-type transistors.

The gate electrode of the first transistor T1 may be electrically connected to the output terminal of the first comparator D1. When the voltage of the first input terminal of the first comparator D1 is greater than the voltage of the second input terminal of the first comparator D1, the output terminal of the first comparator D1 may output a low-level signal, and the first transistor T1 may be in conduction. When the voltage of the first input terminal of the first comparator D1 is less than the voltage of the second input terminal of the first comparator D1, the output terminal of the first comparator D1 may output a high-level signal, and the first transistor T1 may be in disconnection.

The gate electrode of the second transistor T2 may be electrically connected to the output terminal of the second comparator D2. When the voltage of the first input terminal of the second comparator D2 is greater than the voltage of the second input terminal of the second comparator D2, the output terminal of the second comparator D2 may output a low-level signal, and the second transistor T2 may be in conduction. When the voltage of the first input terminal of the second comparator D2 is less than the voltage of the second input terminal of the second comparator D2, the output terminal of the second comparator D2 may output a high-level signal, and the second transistor T2 may be in disconnection.

The first electrode of the first transistor T1 may be electrically connected to the first voltage signal terminal V, the second electrode of the first transistor T1 may be electrically connected to the first electrode of the second transistor T2, and the second electrode of the second transistor T2 may be electrically connected to the third switch unit 33. When the first transistor T1 and the second transistor T2 are both in conduction, the first voltage signal terminal V may transmit the first voltage signal to the third switch unit 33; and when the third switch unit 33 is in conduction, the first voltage signal terminal V may transmit the first voltage signal to the liquid crystal capacitor C1. When any one or both of the first transistor T1 and the second transistor T2 is in disconnection, the first voltage signal of the first voltage signal terminal V may not be transmitted to the third switch unit 33.

Figure 13:
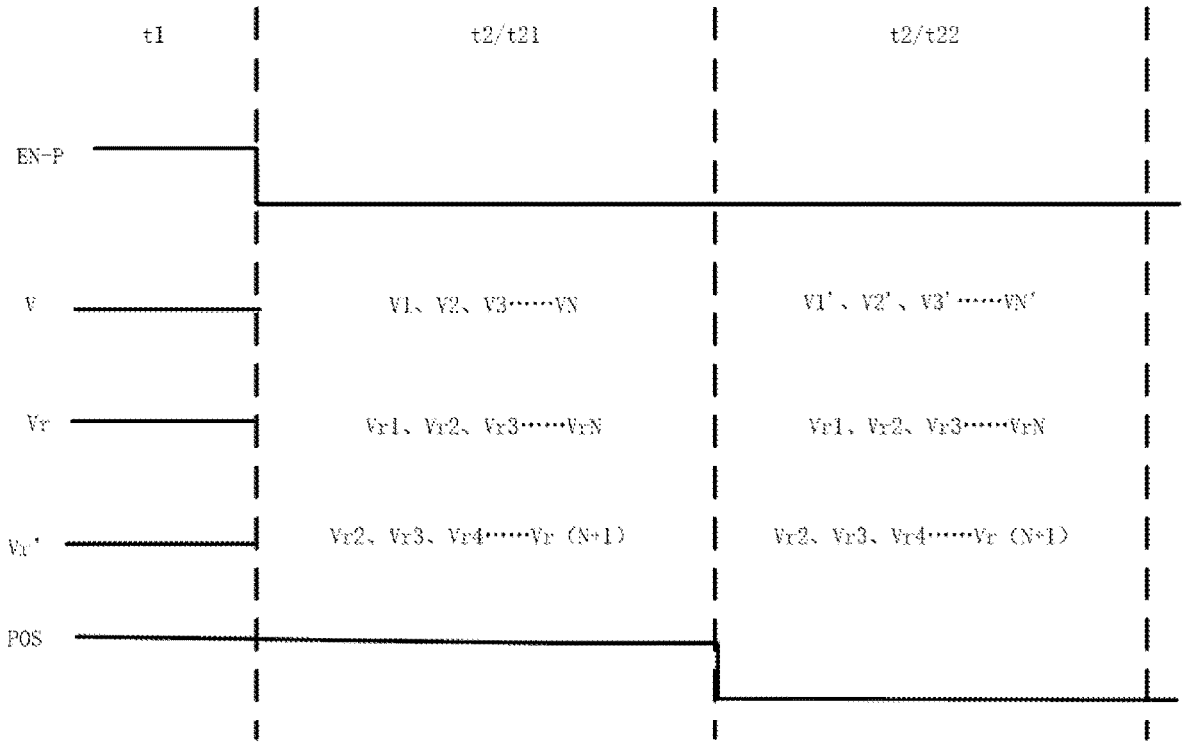
FIG. 13 illustrates another drive sequence diagram of a pixel circuit according to various embodiments of the present disclosure.

FIG. 13 illustrates another drive sequence diagram of the pixel circuit according to various embodiments of the present disclosure. Referring to FIGS. 7 and 13, optionally, the pixel circuit may further include the sixth switch unit 34. The control terminal of the sixth switch unit 34 may be electrically connected to the second control-signal terminal POS, the first terminal of the sixth switch unit 34 may be electrically connected to the first terminal of the liquid crystal capacitor C1; and the second terminal of the sixth switch unit 34 may be electrically connected to the first terminal of the storage capacitor C2.

In the first polarity display stage t21, the sixth switch unit 34 may be turned on for conduction; and in the second polarity display stage t22, the sixth switch unit 34 may be turned off for disconnection.

For example, referring to FIGS. 7 and 13, when the pixel circuit is in the static display stage t2, the static display stage t2 may include the first polarity display stage t21 and the second polarity display stage t22 that are alternately performed. In the first polarity display stage t21, the first voltage signal transmitted to the liquid crystal capacitor C1 via the first voltage signal terminal V may have a positive polarity, and in the second polarity display stage t22, the first voltage signal transmitted to the liquid crystal capacitor C1 via the first voltage signal terminal V may have a negative polarity, which may realize the polarity reversal of the voltage difference between two terminals of the liquid crystal capacitor C1 and effectively prevent liquid crystal polarization during the static display stage.

The pixel circuit may further include the sixth switch unit 34; the control terminal of the sixth switch unit 34 may be electrically connected to the second control-signal terminal POS; the first terminal of the sixth switch unit 34 may be electrically connected to the first terminal of the liquid crystal capacitor C1; and the second terminal of the sixth switch unit 34 may be electrically connected to the first terminal of the storage capacitor C2. In the first polarity display stage t21, the sixth switch unit 34 may be turned on for conduction, and the storage capacitor C2 may be charged through the first voltage signal terminal V, which may effectively prevent the leakage of the storage capacitor C2 after long time static display from causing the voltage of the first terminal of the storage capacitor C2 to deviate from the original grayscale data voltage, such that the deviation may be prevented from affecting the determination of conduction and disconnection of the voltage compensation unit 20. In the second polarity display stage t22, the first voltage signal transmitted to the liquid crystal capacitor C1 via the first voltage signal terminal V may have a negative polarity, and the sixth switch unit 34 may be turned off for disconnection, which may prevent the first voltage signal transmitted from the first voltage signal terminal V to the liquid crystal capacitor C1 from affecting the storage capacitor C2 in the second polarity display stage.

Figure 14:
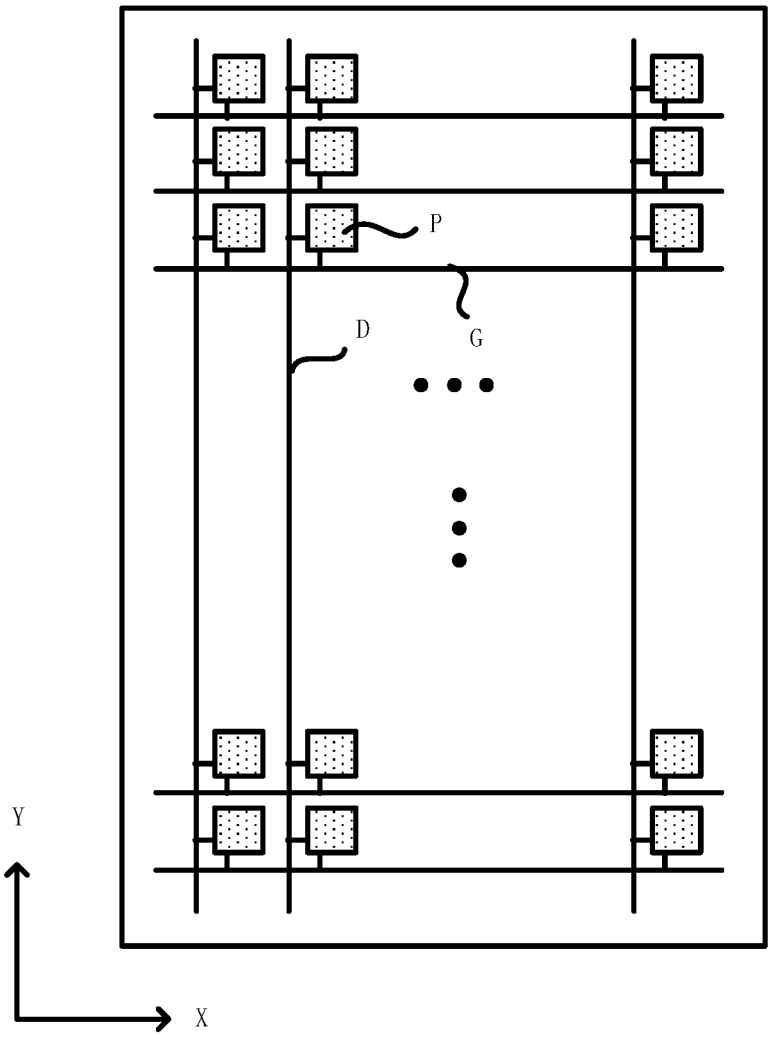
FIG. 14 illustrates a planar structural schematic of a display panel according to various embodiments of the present disclosure.

FIG. 14 illustrates a planar structural schematic of a display panel according to various embodiments of the present disclosure. Referring to FIG. 14, the display panel, provided in one embodiment, may include a plurality of scan lines G, a plurality of data lines D, and a plurality of pixels P. The plurality of scan lines G may extend along the first direction X and be arranged along the second direction Y; the plurality of data lines D may extend along the second direction Y and be arranged along the first direction X; the plurality of pixels P may be arranged in an array along the first direction X and the second direction Y, where the first direction X may intersect the second direction Y.

Each pixel P may include one pixel circuit (not shown in FIG. 14). Referring to FIG. 1, the pixel circuit may include the data write unit 10, the voltage compensation unit 20, the first switch unit 31, the second switch unit 32, the third switch unit 33, the liquid crystal capacitor C1, and the storage capacitor C2.

The data write unit 10 may be electrically connected to the first terminal of the first switch unit 31 and the first terminal of the second switch unit 42.

The second terminal of the first switch unit 31 may be electrically connected to the first terminal of the liquid crystal capacitor C1, and the control terminal of the first switch unit 31 may be electrically connected to the first control-signal terminal EN-P.

The second terminal of the second switch unit 32 may be electrically connected to the first terminal of the storage capacitor C2, and the control terminal of the second switch unit 32 may be electrically connected to the first control-signal terminal EN-P.

The first terminal of the third switch unit 33 may be electrically connected to the voltage compensation unit 20; the second terminal of the third switch unit 33 may be electrically connected to the first terminal of the liquid crystal capacitor C1; and the control terminal of the third switch unit 33 may be electrically connected to the first control-signal terminal EN-P.

The voltage compensation unit 20 may be electrically connected to the first terminal of the storage capacitor C2, and the voltage compensation unit 20 may be electrically connected to each of the first reference voltage signal terminal Vr, the second reference voltage signal terminal Vr', and the first voltage signal terminal V.

The second terminal of the liquid crystal capacitor C1 may be electrically connected to the first common voltage signal terminal Vcom1.

The second terminal of the storage capacitor C2 may be electrically connected to the second common voltage signal terminal Vcom2.

In the dynamic display stage, the first switch unit 31 and the second switch unit 32 may be turned on for conduction, and the third switch unit 33 may be turned off for disconnection. The data write unit 10 may transmit the data voltage signal on the data line D to the liquid crystal capacitor C1 and the storage capacitor C2.

In the static display stage, the first switch unit 31 and the second switch unit 32 may be turned off for disconnection, and the third switch unit 33 may be turned on for conduction. The voltage compensation unit 20 may be turned on for conduction by controlling the first reference voltage signal of the first reference voltage signal terminal Vr, the second reference voltage signal of the second reference voltage signal terminal Vr', and the potential signal of the first terminal of the storage capacitor C2. The first voltage signal terminal Vr may transmit the first voltage signal to the liquid crystal capacitor C1 through the voltage compensation unit 20.

For example, referring to FIGS. 1 and 14, the display panel, provided in one embodiment, may include the plurality of scan lines G, the plurality of data lines D, and the plurality of pixels P. The plurality of scan lines G may extend along the first direction X and be arranged along the second direction Y; the plurality of data lines D may extend along the second direction Y and be arranged along the first direction X; the plurality of pixels P may be arranged in an array along the first direction X and the second direction Y, where the first direction X may intersect the second direction Y.

Each pixel P may include one pixel circuit. In the pixel circuit, the control terminal of the data write unit 10 may be electrically connected to a scan line G; the first terminal of the data write unit 10 may be electrically connected to a data line D; the second terminal of the data write unit 10 may be electrically connected to the first terminal of the first switch unit 31 and the first terminal of the second switch unit 42; and the data write unit 10 may be controlled to be in conduction and disconnection through the scan line G. When the data write unit 10 is in conduction, the data voltage signal on the data line D may be transmitted to the first terminal of the first switch unit 31 and the first terminal of the second switch unit 42.

In the pixel circuit, the second terminal of the first switch unit 31 may be electrically connected to the first terminal of the liquid crystal capacitor C1; the control terminal of the first switch unit 31 may be electrically connected to the first control-signal terminal EN-P; the second terminal of the second switch unit 32 may be electrically connected to the first terminal of the storage capacitor C2; the control terminal of the second switch unit 32 may be electrically connected to the first control-signal terminal EN-P; the first terminal of the third switch unit 33 may be electrically connected to the voltage compensation unit 20; the second terminal of the third switch unit 33 may be electrically connected to the first terminal of the liquid crystal capacitor C1; and the control terminal of the third switch unit 33 may be electrically connected to the first control-signal terminal EN-P. In the dynamic display stage, the first switch unit 31 and the second switch unit 32 may be controlled to be in conduction and the third switch unit 33 may be controlled to be in disconnection by the signal of the first control-signal terminal EN-P; and the data write unit 10 may transmit the data voltage signal on the data line D to the liquid crystal capacitor C1 and the storage capacitor C2. The display panel may generate a corresponding liquid crystal deflection electric field, based on the liquid crystal capacitor C1, according to the data voltage signal on the data line D to implement the dynamic display of the display panel; and the storage capacitor C2 may store the data voltage signal on the data line D simultaneously.

The voltage compensation unit 20 may be electrically connected to the first terminal of the storage capacitor C2; the voltage compensation unit 20 may be electrically connected to the first reference voltage signal terminal Vr, the second reference voltage signal terminal Vr', and the first voltage signal terminal V; the second terminal of the liquid crystal capacitor C1 may be electrically connected to the first common voltage signal terminal Vcom1; and the second terminal of the storage capacitor C2 may be electrically connected to the second common voltage signal terminal Vcom2. In the static display stage, the first switch unit 31 and the second switch unit 32 may be controlled to be in disconnection and the third switch unit 33 may be controlled to be in conduction by the signal of the first control-signal terminal EN-P. The voltage compensation unit 20 may be controlled to be in conduction by the first reference voltage signal of the first reference voltage signal terminal Vr, the second reference voltage signal of the second reference voltage signal terminal Vr', and the potential signal of the first terminal of the storage capacitor C2. The first voltage signal terminal Vr may transmit the first voltage signal to the liquid crystal capacitor C1 through the voltage compensation unit 20; and the display panel may generate a corresponding liquid crystal deflection electric field, based on the liquid crystal capacitor C1, according to the first voltage signal provided by the first voltage signal terminal Vr. At this point, the first voltage signal provided by the first voltage signal terminal Vr may correspond to the data voltage signal of each display grayscale, thereby supporting the color picture display in the static display stage.

Moreover, in the existing technology, the storage circuit may be disposed to store the data voltage in the normal display stage, and the data voltage may be directly provided to the liquid crystal capacitor in the static display stage. In the static display stage, the storage circuit may have leakage, and the data voltage provided by the storage circuit may inevitably deviate from the original grayscale data voltage with the time accumulation, which may affect the display effect of the display panel in the static display stage. According to the pixel circuit provided in one embodiment, the display panel may generate a corresponding liquid crystal deflection electric field, based on the liquid crystal capacitor C1, according to the first voltage signal provided by the first voltage signal terminal Vr, and the data voltage signal may not be provided to the liquid crystal capacitor via the storage circuit. Therefore, the situation that the data voltage signal provided by the storage circuit to the liquid crystal capacitor deviates from the data voltage of the original grayscale due to the time accumulation in the static display stage may not occur, which may be beneficial for improving the display effect of the display panel.

Referring to FIGS. 1 and 14, optionally, the display panel may be a reflective display panel. In the dynamic display stage, the display panel may use the light of the backlight as the light source of the display panel; and in the static display stage, the display panel may use external ambient light as the light source of the display panel.

A display device, including the above-mentioned display panel, may be provided in one embodiment.

Figure 15:
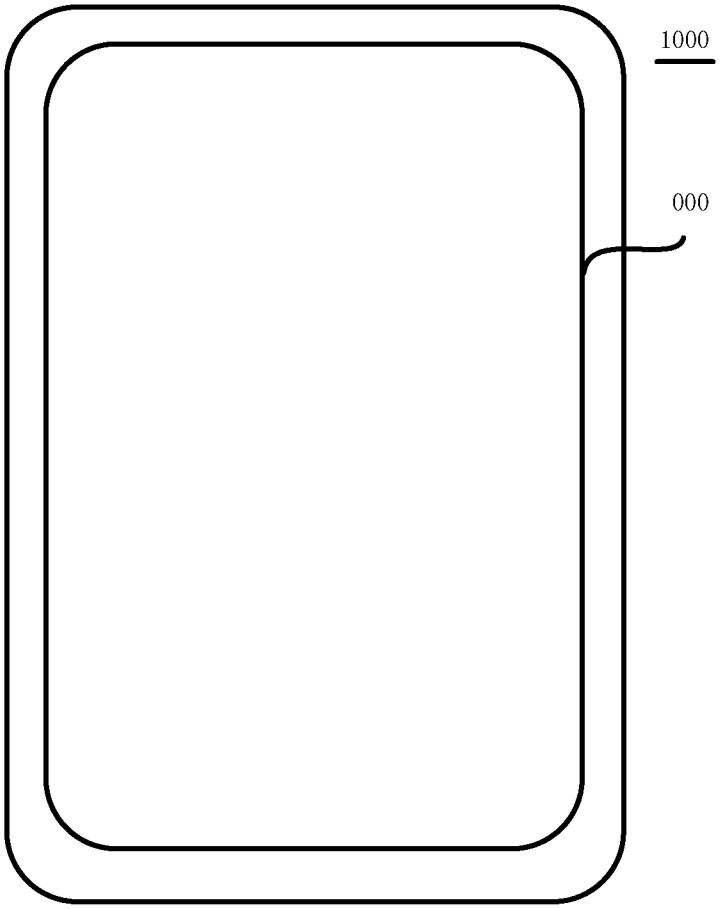
FIG. 15 illustrates a planar structural schematic of a display device according to various embodiments of the present disclosure.

Referring to FIG. 15, FIG. 15 illustrates a planar structural schematic of a display device according to various embodiments of the present disclosure. A display device 1000 provided in FIG. 15 may include a display panel 000, where the display panel may be the display panel 000 provided by any of the above-mentioned embodiments of the present disclosure. A mobile phone may be taken as an example to illustrate the display device 1000 in one embodiment shown in FIG. 15. It should be understood that the display device provided in the embodiments of the present disclosure may be a computer, a television, a vehicle-mounted display device, and other display device with a display function, which may not be limited according to various embodiments of the present disclosure. The display device provided by the embodiments of the present disclosure may have the beneficial effects of the display panel provided by the embodiments of the present disclosure. The details may refer to the description of the display panel in the above-mentioned embodiments, which may not be described in detail herein.

From the above-mentioned embodiments, it can be seen that the pixel circuit and its drive method, the display panel, and the display device provided by the present disclosure may achieve at least the following beneficial effects.

For the pixel circuit provided in the present disclosure, in the dynamic display stage, the first switch unit and the second switch unit may be controlled to be in conduction, and the third switch unit may be controlled to be in disconnection through the signal of the first control-signal terminal; and the data write unit may transmit the data voltage signal on the data line to the liquid crystal capacitor and the storage capacitor. The display panel may generate a corresponding liquid crystal deflection electric field, based on the liquid crystal capacitor, according to the data voltage signal on the data line, and the storage capacitor may store the data voltage signal on the data line simultaneously. The voltage compensation unit may be electrically connected to the first terminal of the storage capacitor; the voltage compensation unit may be electrically connected to the first reference voltage signal terminal, the second reference voltage signal terminal, and the first voltage signal terminal; the second terminal of the liquid crystal capacitor may be electrically connected to the first common voltage signal terminal; and the second terminal of the storage capacitor may be electrically connected to the second common voltage signal terminal. In the static display stage, the first switch unit and the second switch unit may be controlled to be in disconnection and the third switch unit may be controlled to be in conduction through the signal of the first control-signal terminal. The voltage compensation unit may be controlled to be in conduction through the first reference voltage signal of the first reference voltage signal terminal, the second reference voltage signal of the second reference voltage signal terminal, and the potential signal of the first terminal of the storage capacitor; the first voltage signal terminal may transmit the first voltage signal to the liquid crystal capacitor through the voltage compensation unit; and the display panel may generate a corresponding liquid crystal deflection electric field, based on the liquid crystal capacitor, according to the first voltage signal provided by the first voltage signal terminal. At this point, the first voltage signal provided by the first voltage signal terminal may correspond to the data voltage of each display grayscale, thereby supporting the color picture display in the static display stage. Furthermore, in the existing technology, the storage circuit may be disposed to store the data voltage in the normal display stage, and the data voltage may be directly provided to the liquid crystal capacitor in the static display stage; in the static display stage, the storage circuit may have leakage, and the data voltage provided by the storage circuit may inevitably deviate from the original grayscale data voltage with the time accumulation, which may affect the display effect of the display panel in the static display stage. According to the pixel circuit provided in one embodiment, the display panel may generate a corresponding liquid crystal deflection electric field, based on the liquid crystal capacitor, according to the first voltage signal provided by the first voltage signal terminal, and the data voltage signal may not be provided to the liquid crystal capacitor via the storage circuit. Therefore, the situation that the data voltage signal provided by the storage circuit to the liquid crystal capacitor deviates from the data voltage of the original grayscale due to the time accumulation in the static display stage may not occur, which may be beneficial for improving the display effect of the display panel.

Although certain embodiments of the present disclosure have been described in detail through examples, those skilled in the art should understand that the above-mentioned examples are merely for illustration and not for limiting the scope of the present disclosure. Those skilled in the art should understand that the above-mentioned embodiments may be modified without departing from the scope and spirit of the present disclosure, and the scope of the present disclosure is defined by the appended claims.

What is claimed is:

1. A pixel circuit, comprising:

a data write unit, a voltage compensation unit, a first switch unit, a second switch unit, a third switch unit, a liquid crystal capacitor, and a storage capacitor, wherein:

the data write unit is electrically connected to each of a first terminal of the first switch unit and a first terminal of the second switch unit;

a second terminal of the first switch unit is electrically connected to a first terminal of the liquid crystal capacitor, and a control terminal of the first switch unit is electrically connected to a first control-signal terminal;

a second terminal of the second switch unit is electrically connected to a first terminal of the storage capacitor, and a control terminal of the second switch unit is electrically connected to the first control-signal terminal;

a first terminal of the third switch unit is electrically connected to the voltage compensation unit, a second terminal of the third switch unit is electrically connected to the first terminal of the liquid crystal capacitor, and a control terminal of the third switch unit is electrically connected to the first control-signal terminal;

the voltage compensation unit is electrically connected to the first terminal of the storage capacitor, and the voltage compensation unit is electrically connected to each of a first reference voltage signal terminal, a second reference voltage signal terminal, and a first voltage signal terminal;

a second terminal of the liquid crystal capacitor is electrically connected to a first common voltage signal terminal; and a second terminal of the storage capacitor is electrically connected to a second common voltage signal terminal;

a dynamic display stage, wherein the first switch unit and the second switch unit are turned on for conduction, and the third switch unit is turned off for disconnection; and the data write unit transmits a data voltage signal on a data line to the liquid crystal capacitor and the storage capacitor; and a static display stage, wherein the first switch unit and the second switch unit are turned off for disconnection, and the third switch unit is turned on for conduction; the voltage compensation unit is controlled to be in conduction through a first reference voltage signal of the first reference voltage signal terminal, a second reference voltage signal of the second reference voltage signal terminal, and a potential signal of the first terminal of the storage capacitor; and the first voltage signal terminal transmits a first voltage signal to the liquid crystal capacitor through the voltage compensation unit, wherein:

the voltage compensation unit includes a first control unit and a second control unit which are electrically connected with each other;

the first control unit is electrically connected to each of the first reference voltage signal terminal, the first terminal of the storage capacitor, and the first voltage signal terminal;

the second control unit is electrically connected to the second reference voltage signal terminal, the first terminal of the storage capacitor, and the third switch unit; and in the static display stage, the first control unit is controlled to be in conduction through the first reference voltage signal of the first reference voltage signal terminal and the potential signal of the first terminal of the storage capacitor; the second control unit is controlled to be in conduction through the second reference voltage signal of the second reference voltage signal terminal and the potential signal of the first terminal of the storage capacitor; and the first voltage signal terminal transmits the first voltage signal to the liquid crystal capacitor through the first control unit and the second control unit.

2. The pixel circuit according to claim 1, wherein:

the first control unit includes a first comparator and a fourth switch unit; a first input terminal of the first comparator is electrically connected to the first terminal of the storage capacitor; a second input terminal of the first comparator is electrically connected to the first reference voltage signal terminal; an output terminal of the first comparator is electrically connected to a control terminal of the fourth switch unit; and a first terminal of the fourth switch unit is electrically connected to the first voltage signal terminal;

the second control unit includes a second comparator and a fifth switch unit; a first input terminal of the second comparator is electrically connected to the second reference voltage signal terminal; a second input terminal of the second comparator is electrically connected to the first terminal of the storage capacitor; an output terminal of the second comparator is electrically connected to a control terminal of the fifth switch unit; a first terminal of the fifth switch unit is electrically connected to a second terminal of the fourth switch unit; and a second terminal of the fifth switch unit is electrically connected to the third switch unit;

when a voltage of the first input terminal of the first comparator is greater than a voltage of the second input terminal of the first comparator, the output terminal of the first comparator controls the fourth switch unit to be in conduction; and when the voltage of the first input terminal of the first comparator is less than the voltage of the second input terminal of the first comparator, the output terminal of the first comparator controls the fourth switch unit to be in disconnection; and when a voltage of the first input terminal of the second comparator is greater than a voltage of the second input terminal of the second comparator, the output terminal of the second comparator controls the fifth switch unit to be in conduction; and when the voltage of the first input terminal of the second comparator is less than the voltage of the second input terminal of the second comparator, the output terminal of the second comparator controls the fifth switch unit to be in disconnection.

3. The pixel circuit according to claim 2, wherein:

the fourth switch unit includes a first transistor; the fifth switch unit includes a second transistor; and the first transistor and the second transistor are both P-type transistors;

a gate electrode of the first transistor is electrically connected to the output terminal of the first comparator; a first electrode of the first transistor is electrically connected to the first voltage signal terminal; a second electrode of the first transistor is electrically connected to a first electrode of the second transistor; a gate electrode of the second transistor is electrically connected to the output terminal of the second comparator; and a second electrode of the second transistor is electrically connected to the third switch unit;

when the voltage of the first input terminal of the first comparator is greater than the voltage of the second input terminal of the first comparator, the output terminal of the first comparator outputs a low-level signal; and when the voltage of the first input terminal of the first comparator is less than the voltage of the second input terminal of the first comparator, the output terminal of the first comparator outputs a high-level signal; and when the voltage of the first input terminal of the second comparator is greater than the voltage of the second input terminal of the second comparator, the output terminal of the second comparator outputs a low-level signal; and when the voltage of the first input terminal of the second comparator is less than the voltage of the second input terminal of the second comparator, the output terminal of the second comparator outputs a high-level signal.

4. The pixel circuit according to claim 1, wherein:

the first switch unit includes a third transistor, the second switch unit includes a fourth transistor, and the third switch unit includes a fifth transistor; and the third transistor and the fourth transistor are N-type transistors, and the fifth transistor is a P-type transistor; or the third transistor and the fourth transistor are P-type transistors, and the fifth transistor is a N-type transistor.

5. The pixel circuit according to claim 1, further including:

a sixth switch unit, wherein:

a control terminal of the sixth switch unit is electrically connected to a second control-signal terminal, a first terminal of the sixth switch unit is electrically connected to the first terminal of the liquid crystal capacitor, and a second terminal of the sixth switch unit is electrically connected to the first terminal of the storage capacitor;

the static display stage includes a first polarity display stage and a second polarity display stage that are alternately performed;

in the first polarity display stage, the first voltage signal transmitted to the liquid crystal capacitor via the first voltage signal terminal has a positive polarity, and the sixth switch unit is turned on for conduction; and in the second polarity display stage, the first voltage signal transmitted to the liquid crystal capacitor via the first voltage signal terminal has a negative polarity, and the sixth switch unit is turned off for disconnection.

6. The pixel circuit according to claim 5, wherein:

the sixth switch unit includes a sixth transistor, wherein a gate electrode of the sixth transistor is electrically connected to the second control-signal terminal, a first electrode of the sixth transistor is electrically connected to the first terminal of the liquid crystal capacitor, and a second terminal of the sixth transistor is electrically connected to the first terminal of the storage capacitor.

7. The pixel circuit according to claim 1, further including:

a first storage unit, wherein a first terminal of the first storage unit is electrically connected to the first terminal of the liquid crystal capacitor, and a second terminal of the first storage unit is electrically connected to the second terminal of the liquid crystal capacitor.

8. The pixel circuit according to claim 7, wherein:

the first storage unit includes a first capacitor, wherein a first terminal of the first capacitor is electrically connected to the first terminal of the liquid crystal capacitor, and a second terminal of the first capacitor is electrically connected to the second terminal of the liquid crystal capacitor.

9. The pixel circuit according to claim 1, wherein:

the data write unit includes a seventh transistor, wherein a gate electrode of the seventh transistor is electrically connected to a scan line, a first electrode of the seventh transistor is electrically connected to a data line, and a second electrode of the seventh transistor is electrically connected to each of the first switch unit and the second switch unit.

10. The pixel circuit according to claim 1, wherein in the static display stage, the voltage compensation unit is controlled to be in conduction by comparing the first reference voltage signal of the first reference voltage signal terminal and the second reference voltage signal of the second reference voltage signal terminal, respectively, with the potential signal of the first terminal of the storage capacitor.

11. A method for driving a pixel circuit, wherein:

the pixel circuit includes a data write unit, a voltage compensation unit, a first switch unit, a second switch unit, a third switch unit, a liquid crystal capacitor, and a storage capacitor, wherein:

the data write unit is electrically connected to each of a first terminal of the first switch unit and a first terminal of the second switch unit;

a second terminal of the first switch unit is electrically connected to a first terminal of the liquid crystal capacitor, and a control terminal of the first switch unit is electrically connected to a first control-signal terminal;

a second terminal of the second switch unit is electrically connected to a first terminal of the storage capacitor, and a control terminal of the second switch unit is electrically connected to the first control-signal terminal;

a first terminal of the third switch unit is electrically connected to the voltage compensation unit, a second terminal of the third switch unit is electrically connected to the first terminal of the liquid crystal capacitor, and a control terminal of the third switch unit is electrically connected to the first control-signal terminal;

the voltage compensation unit is electrically connected to the first terminal of the storage capacitor, and the voltage compensation unit is electrically connected to each of a first reference voltage signal terminal, a second reference voltage signal terminal, and a first voltage signal terminal;

a second terminal of the liquid crystal capacitor is electrically connected to a first common voltage signal terminal; and a second terminal of the storage capacitor is electrically connected to a second common voltage signal terminal; and the method for driving the pixel circuit includes:

a dynamic display stage, wherein the first switch unit and the second switch unit are turned on for conduction and the third switch unit is turned off for disconnection; and the data write unit transmits a data voltage signal on a data line to the liquid crystal capacitor and the storage capacitor; and a static display stage, wherein the first switch unit and the second switch unit are turned off for disconnection, and the third switch unit is turned on for conduction; the voltage compensation unit is controlled to be in conduction through a first reference voltage signal of the first reference voltage signal terminal, a second reference voltage signal of the second reference voltage signal terminal, and a potential signal of the first terminal of the storage capacitor; and the first voltage signal terminal transmits a first voltage signal to the liquid crystal capacitor through the voltage compensation unit, wherein:

the voltage compensation unit includes a first control unit and a second control unit which are electrically connected with each other;

the first control unit is electrically connected to each of the first reference voltage signal terminal, the first terminal of the storage capacitor, and the first voltage signal terminal;

the second control unit is electrically connected to the second reference voltage signal terminal, the first terminal of the storage capacitor, and the third switch unit; and in the static display stage, the first control unit is controlled to be in conduction through the first reference voltage signal of the first reference voltage signal terminal and the potential signal of the first terminal of the storage capacitor; the second control unit is controlled to be in conduction through the second reference voltage signal of the second reference voltage signal terminal and the potential signal of the first terminal of the storage capacitor; and the first voltage signal terminal transmits the first voltage signal to the liquid crystal capacitor through the first control unit and the second control unit.

12. The method according to claim 11, wherein:

the static display stage includes a first polarity display stage and a second polarity display stage that are alternately performed; and each of the first polarity display stage and the second polarity display stage includes at least one frame of display period;

in the first polarity display stage, the first voltage signal transmitted to the storage capacitor via the first voltage signal terminal has a positive polarity;

in the second polarity display stage, the first voltage signal transmitted to the storage capacitor via the first voltage signal terminal has a negative polarity;

in one frame of display period at the first polarity display stage, all levels of reference voltage signals in a reference voltage signal group are sequentially inputted to the first reference voltage signal terminal and the second reference voltage signal terminal; all levels of first voltage signals in a first voltage signal group are sequentially inputted to the first voltage signal terminal; the reference voltage signal group includes N+1 levels of the reference voltage signals which increase sequentially; and the first voltage signal group includes N levels of the first voltage signals which increase sequentially;

when the first reference voltage signal terminal is inputted with an n-th level reference voltage signal, the second reference voltage signal terminal is inputted with an (n+1)-th level reference voltage signal, and the first voltage signal terminal is inputted with an n-th level first voltage signal; and a voltage of the n-th level first voltage signal is between a voltage of the n-th level reference voltage signal and a voltage of the (n+1)-th level reference voltage signal, wherein $1 \leq n \leq N$, and n and N are both positive integers;

in one frame of display period at the second polarity display stage, all levels of the reference voltage signals in the reference voltage signal group are sequentially inputted to the first reference voltage signal terminal and the second reference voltage signal terminal; all levels of first voltage signals in a second voltage signal group are sequentially inputted to the first voltage signal terminal; and the reference voltage signal group includes N+1 levels of the reference voltage signals that increase sequentially; and the second voltage signal group includes N levels of the first voltage signals that decrease sequentially;

when the first reference voltage signal terminal is inputted with the n-th level reference voltage signal, the second reference voltage signal terminal is inputted with the (n+1)-th level reference voltage signal, and the first voltage signal terminal is inputted with the n-th level first voltage signal; and an absolute voltage value of the n-th level first voltage signal is between the voltage of the n-th level reference voltage signal and the voltage of the (n+1)-th level reference voltage signal, wherein $1 \leq n \leq N$, and n and N are both positive integers;

the voltage of the n-th level first voltage signal in the first voltage signal group is same as the absolute voltage value of the n-th level first voltage signal in the second voltage signal group; and when a voltage of a first grayscale signal is greater than an m-th level reference voltage signal and less than an (m+1)-th level reference voltage signal, an m-th level first voltage signal is transmitted to the liquid crystal capacitor through the voltage compensation unit, and the voltage of the first grayscale signal is a voltage of the first terminal of the storage capacitor in a last frame of display period of a previous dynamic display stage connected to the static display stage, wherein $1 \leq m \leq N$, and m is a positive integer.

13. The method according to claim 12, wherein:

the first control unit includes a first comparator and a fourth switch unit; a first input terminal of the first comparator is electrically connected to the first terminal of the storage capacitor; a second input terminal of the first comparator is electrically connected to the first reference voltage signal terminal; an output terminal of the first comparator is electrically connected to a control terminal of the fourth switch unit; and a first terminal of the fourth switch unit is electrically connected to the first voltage signal terminal;

the second control unit includes a second comparator and a fifth switch unit; a first input terminal of the second comparator is electrically connected to the second reference voltage signal terminal; a second input terminal of the second comparator is electrically connected to the first terminal of the storage capacitor; an output terminal of the second comparator is electrically connected to a control terminal of the fifth switch unit; a first terminal of the fifth switch unit is electrically connected to a second terminal of the fourth switch unit; and a second terminal of the fifth switch unit is electrically connected to the third switch unit;

when a voltage of the first input terminal of the first comparator is greater than a voltage of the second input terminal of the first comparator, the output terminal of the first comparator controls the fourth switch unit to be in conduction; and when the voltage of the first input terminal of the first comparator is less than the voltage of the second input terminal of the first comparator, the output terminal of the first comparator controls the fourth switch unit to be in disconnection; and when a voltage of the first input terminal of the second comparator is greater than a voltage of the second input terminal of the second comparator, the output terminal of the second comparator controls the fifth switch unit to be in conduction; and when the voltage of the first input terminal of the second comparator is less than the voltage of the second input terminal of the second comparator, the output terminal of the second comparator controls the fifth switch unit to be in disconnection.

14. The method according to claim 13, wherein:

the fourth switch unit includes a first transistor; the fifth switch unit includes a second transistor; and the first transistor and the second transistor are both P-type transistors;

a gate electrode of the first transistor is electrically connected to the output terminal of the first comparator; a first electrode of the first transistor is electrically connected to the first voltage signal terminal; a second electrode of the first transistor is electrically connected to a first electrode of the second transistor; a gate electrode of the second transistor is electrically connected to the output terminal of the second comparator; and a second electrode of the second transistor is electrically connected to the third switch unit;

when the voltage of the first input terminal of the first comparator is greater than the voltage of the second input terminal of the first comparator, the output terminal of the first comparator outputs a low-level signal; and when the voltage of the first input terminal of the first comparator is less than the voltage of the second input terminal of the first comparator, the output terminal of the first comparator outputs a high-level signal; and when the voltage of the first input terminal of the second comparator is greater than the voltage of the second input terminal of the second comparator, the output terminal of the second comparator outputs a low-level signal; and when the voltage of the first input terminal of the second comparator is less than the voltage of the second input terminal of the second comparator, the output terminal of the second comparator outputs a high-level signal.

15. The method according to claim 12, wherein:

the pixel circuit further includes a sixth switch unit, wherein a control terminal of the sixth switch unit is electrically connected to a second control-signal terminal, a first terminal of the sixth switch unit is electrically connected to the first terminal of the liquid crystal capacitor, and a second terminal of the sixth switch unit is electrically connected to the first terminal of the storage capacitor;

in the first polarity display stage, the sixth switch unit is turned on for conduction; and in the second polarity display stage, the sixth switch unit is turned off for disconnection.

16. A display panel, comprising:

a plurality of scan lines, a plurality of data lines, and a plurality of pixels, wherein:

the plurality of scan lines extends along a first direction and is arranged along a second direction; the plurality of data lines extends along the second direction and is arranged along the first direction; the plurality of pixels is arranged in an array along the first direction and the second direction, wherein the first direction intersects the second direction;

each pixel includes one pixel circuit including a data write unit, a voltage compensation unit, a first switch unit, a second switch unit, a third switch unit, a liquid crystal capacitor, and a storage capacitor, wherein:

a control terminal of the data write unit is electrically connected to a scan line, a first terminal of the data write unit is electrically connected to a data line, and a second terminal of the data write unit is electrically connected to each of a first terminal of the first switch unit and a first terminal of the second switch unit;

a second terminal of the first switch unit is electrically connected to a first terminal of the liquid crystal capacitor, and a control terminal of the first switch unit is electrically connected to a first control-signal terminal;

a second terminal of the second switch unit is electrically connected to a first terminal of the storage capacitor, and a control terminal of the second switch unit is electrically connected to the first control-signal terminal;

a first terminal of the third switch unit is electrically connected to the voltage compensation unit, a second terminal of the third switch unit is electrically connected to the first terminal of the liquid crystal capacitor, and a control terminal of the third switch unit is electrically connected to the first control-signal terminal;

the voltage compensation unit is electrically connected to the first terminal of the storage capacitor; and the voltage compensation unit is electrically connected to each of a first reference voltage signal terminal, a second reference voltage signal terminal, and a first voltage signal terminal;

a second terminal of the liquid crystal capacitor is electrically connected to a first common voltage signal terminal;

a second terminal of the storage capacitor is electrically connected to a second common voltage signal terminal;

in a dynamic display stage, the first switch unit and the second switch unit are turned on for conduction, and the third switch unit is turned off for disconnection; and the data write unit transmits a data voltage signal on a data line, which is electrically connected to the data write unit, to the liquid crystal capacitor and the storage capacitor; and in a static display stage, the first switch unit and the second switch unit are turned off for disconnection, and the third switch unit is turned on for conduction; the voltage compensation unit is controlled to be in conduction through a first reference voltage signal of the first reference voltage signal terminal, a second reference voltage signal of the second reference voltage signal terminal, and a potential signal of the first terminal of the storage capacitor; and the first voltage signal terminal transmits a first voltage signal to the liquid crystal capacitor through the voltage compensation unit, wherein:

the voltage compensation unit includes a first control unit and a second control unit which are electrically connected with each other;

the first control unit is electrically connected to each of the first reference voltage signal terminal, the first terminal of the storage capacitor, and the first voltage signal terminal;

the second control unit is electrically connected to the second reference voltage signal terminal, the first terminal of the storage capacitor, and the third switch unit; and in the static display stage, the first control unit is controlled to be in conduction through the first reference voltage signal of the first reference voltage signal terminal and the potential signal of the first terminal of the storage capacitor; the second control unit is controlled to be in conduction through the second reference voltage signal of the second reference voltage signal terminal and the potential signal of the first terminal of the storage capacitor; and the first voltage signal terminal transmits the first voltage signal to the liquid crystal capacitor through the first control unit and the second control unit.

17. The display panel according to claim 16, further including:

a reflective display panel.

18. A display device, including the display panel according to claim 16.

* * * * *